US009378686B2

(12) United States Patent
Pappas

(10) Patent No.: US 9,378,686 B2
(45) Date of Patent: Jun. 28, 2016

(54) DISPLAY CIRCUIT INCORPORATING DATA FEEDBACK LOOP

(71) Applicant: Pixtronix, Inc., San Diego, CA (US)

(72) Inventor: Ilias Pappas, Burlington, MA (US)

(73) Assignee: Pixtronix, Inc., San Diego, CA (US)

( * ) Notice: Subject to any disclaimer, the term of this patent is extended or adjusted under 35 U.S.C. 154(b) by 92 days.

(21) Appl. No.: 14/267,687

(22) Filed: May 1, 2014

(65) Prior Publication Data

US 2015/0317935 A1 Nov. 5, 2015

(51) Int. Cl.
*G09G 3/34* (2006.01)

(52) U.S. Cl.
CPC ..... *G09G 3/3433* (2013.01); *G09G 3/3473* (2013.01); *G09G 2300/0842* (2013.01); *G09G 2310/0251* (2013.01); *G09G 2310/0275* (2013.01); *G09G 2320/0266* (2013.01); *G09G 2340/16* (2013.01)

(58) Field of Classification Search
CPC ..... G09G 2320/0266; G09G 2340/16; G09G 3210/0275; G09G 3/3433–3/3493
USPC ..... 345/88
See application file for complete search history.

(56) References Cited

U.S. PATENT DOCUMENTS 7,061,660 B1 * 6/2006 Chen ..... G02B 26/001 257/E31.121
7,839,367 B2 11/2010 Fish et al.
2006/0208961 A1 9/2006 Nathan et al.
2008/0203930 A1 8/2008 Budzelaar et al.
2009/0064038 A1 * 3/2009 Fleischman ..... G06F 9/44505 715/810
2009/0316381 A1 12/2009 Kurt
2010/0149143 A1 * 6/2010 Yamamoto ..... G09G 3/3225 345/205
2011/0007064 A1 * 1/2011 Chiang ..... G09G 3/3674 345/213
2011/0090196 A1 4/2011 Li et al.
2013/0082607 A1 * 4/2013 Gandhi ..... G09G 3/3413 315/153

FOREIGN PATENT DOCUMENTS

WO 2013008528 A1 1/2013

OTHER PUBLICATIONS

International Search Report and Written Opinion—PCT/US2015/023356—ISA/EPO—Sep. 7, 2015.

* cited by examiner

*Primary Examiner* — Larry Sternbane
(74) *Attorney, Agent, or Firm* — Edward A. Gordon; Foley & Lardner LLP

(57) ABSTRACT

This disclosure provides systems, methods, and apparatus for providing pixel circuits for controlling the state of operation of light modulators in a display device. The state of operation of the light modulator can be controlled by the pixel circuit based on a data voltage stored in a data storage element of the pixel circuit. The pixel circuit includes an actuation circuit for providing an actuation voltage to the light modulator and a feedback circuit for providing a positive feedback voltage from an output node of the actuation circuit to an input node of the actuation circuit. In some implementations, the feedback circuit includes the data storage element connected between the input node and the output node.

30 Claims, 19 Drawing Sheets

F5

F5

DISPLAY CIRCUIT INCORPORATING DATA FEEDBACK LOOP

TECHNICAL FIELD

This disclosure relates to the field of imaging displays, and in particular to pixel circuits for display elements.

DESCRIPTION OF THE RELATED TECHNOLOGY

Electromechanical systems (EMS) include devices having electrical and mechanical elements, actuators, transducers, sensors, optical components such as mirrors and optical films, and electronics. EMS devices or elements can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

In some implementations, display devices can include electromechanical elements for displaying images. For example, some display devices can include an array of electromechanical (MEMS or NEMS) light modulators for manipulating light emitted by a backlight before the light reaches a viewer. In some implementations, the array of light modulators can selectively manipulate the light by blocking, allowing, or partially allowing the light from reaching the viewer. The operation of the light modulators can be controlled using pixel circuitry coupled to the array of light modulators. The pixel circuitry can control the array of light modulators based on image frame data.

SUMMARY

The systems, methods and devices of the disclosure each have several innovative aspects, no single one of which is solely responsible for the desirable attributes disclosed herein.

One innovative aspect of the subject matter described in this disclosure can be implemented in an apparatus including a data loading circuit capable of accepting a data voltage, a light modulator capable of selectively allowing passage of light, an actuation circuit having an input node and an output node, the input node coupled to the data loading circuit and the output node coupled to the light modulator, capable of providing an actuation voltage to the light modulator based on the data voltage, and a positive feedback circuit capable of providing a positive feedback voltage from the output node to the input node.

In some implementations, the positive feedback circuit includes a data storing capacitor coupled between the input node and the output node, where the data storing capacitor is capable of storing the data voltage. In some implementations, the data storing capacitor is a floating capacitor. In some implementations, the feedback circuit includes a switch capable of providing an actuation voltage to the input node in response to the output node being charged to the actuation voltage via the actuation circuit.

In some implementations, the light modulator includes a shutter terminal, a first actuator terminal and a second actuator terminal, where the output node is coupled to one of the first actuator terminal and the second actuator terminal. In some implementations, a voltage at the shutter terminal is toggled such that a previous state of the light modulator is preserved when the output node is discharged by the actuation circuit. In some implementations, the light modulator includes a shutter terminal, a first actuator terminal and a second actuator terminal, where the output node is coupled to the shutter terminal.

In some implementations, the voltages at the first actuator terminal and the second actuator terminal are switched from being complementary to being non-complementary such that a previous state of the light modulator is preserved when the output node is discharged by the actuation circuit. In some implementations, a period of a state of the light modulator is a function of the magnitude of the data voltage. In some implementations, the display device uses analog grayscale technique for displaying an image.

In some implementations, the apparatus includes a display including an array of the display elements, and a corresponding array of the circuits, a processor that is capable of communicating with the display, the processor being capable of processing image data and a memory device that is capable of communicating with the processor.

In some implementations, the display further includes a driver circuit capable of sending at least one signal to the display and a controller capable of sending at least a portion of the image data to the driver circuit. In some implementations, the apparatus further includes an image source module capable of sending the image data to the processor, where the image source module includes at least one of a receiver, transceiver, and transmitter. In some implementations, the apparatus further includes an input device capable of receiving input data and to communicate the input data to the processor.

Another innovative aspect of the subject matter described in this disclosure can be implemented in a method including accepting a data voltage from a data interconnect, discharging an output node of an actuation circuit, where the output node is coupled to a light modulator capable of switching between two discrete states, charging the output node to an actuation voltage via the actuation circuit based on the data voltage, and providing a positive feedback voltage from the output node to an input node of the actuation circuit.

In some implementations, accepting the data voltage from a data interconnect includes storing the data voltage into a data storing capacitor. In some implementations, accepting the data voltage from the data interconnect includes accepting the data voltage from the data interconnect concurrently with discharging the output node of the actuation circuit. In some implementations, providing the positive feedback voltage from the output node to the input node of the actuation circuit includes charging the input node in response to a charging of the output node via the actuation circuit.

In some implementations, charging the input node in response to a charging of the output node via the actuation circuit includes charging the input node via a switch. In some implementations, charging the input node in response to a charging of the output node via the actuation circuit includes charging the input node via the data storing capacitor to a voltage that is greater than the voltage at the output node by the magnitude of the data voltage.

In some implementations, the method further includes providing a voltage at the output node to one of at least two actuators of the light modulator. In some such implementations, the method further includes toggling a voltage at the shutter terminal during discharging the output node of the actuation circuit such that a previous state of the light modulator is preserved.

In some implementations, the method further includes providing a voltage at the output node to a shutter terminal of the light modulator. In some such implementations, the method includes switching the voltages at the first actuator terminal and the second actuator terminal from being complementary to being non-complementary during discharging the output node.

In some implementations, charging the output node to an actuation voltage via the actuation circuit based on the data voltage includes charging the output node at a rate that is a function of the magnitude of the data voltage. In some such implementations, the method includes displaying an image using analog grayscale technique.

Another innovative aspect of the subject matter described in this disclosure can be implemented in an apparatus including a circuit for controlling a display element, including data acquiring means for accepting a data voltage from a data interconnect, discharging means for discharging an output node of an actuation circuit, the output node coupled to a light modulator, charging means for charging the output node to an actuation voltage via the actuation circuit based on the data voltage and feedback means providing a positive feedback voltage from the output node to an input node of the actuation circuit.

In some implementations, the data acquiring means are capable of storing the data voltage on a data storing capacitor. In some implementations, the feedback means are capable of charging the input node in response to a charging of the output node via the charging means. In some implementations, the feedback means includes a floating data storing capacitor coupled between the input node and the output node, the floating data storing capacitor capable of storing the data voltage.

Details of one or more implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
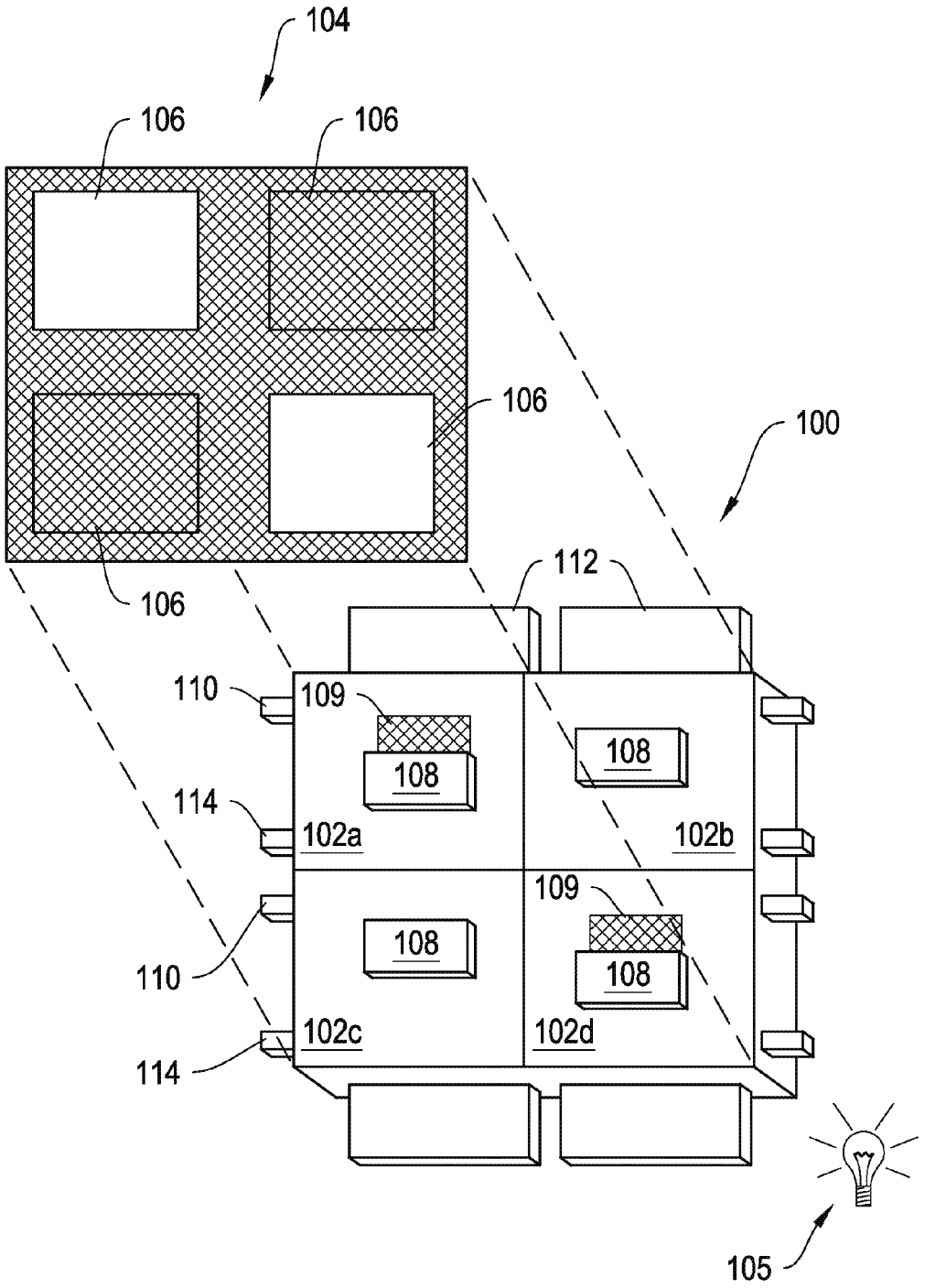
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that is capable of displaying an image, whether in motion (such as video) or stationary (such as still images), and whether textual, graphical or pictorial. The concepts and examples provided in this disclosure may be applicable to a variety of displays, such as liquid crystal displays (LCDs), organic light-emitting diode (OLED) displays, field emission displays, and electromechanical systems (EMS) and microelectromechanical (MEMS)-based displays, in addition to displays incorporating features from one or more display technologies.

The described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, handheld or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, wearable devices, clocks, calculators, television monitors, flat panel displays, electronic reading devices (such as e-readers), computer monitors, auto displays (such as odometer and speedometer displays), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, in addition to non-EMS applications), aesthetic structures (such as display of images on a piece of jewelry or clothing) and a variety of EMS devices.

The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

A display apparatus includes pixel circuits for controlling the state of operation of shutter based light modulators. The state of operation of the light modulator is controlled by the pixel circuit based on a data voltage stored in a data storage element of the pixel circuit. The pixel circuit includes an actuation circuit for providing an actuation voltage to the light modulator and a feedback circuit for providing a positive feedback voltage from an output node of the actuation circuit to an input node of the actuation circuit. In some implementations, the feedback circuit includes the data storage element connected between the input node and the output node.

In some implementations, the output node is connected to one of two actuators of the light modulator. In some such implementations, the voltage on a shutter of the light modulator is toggled during a data loading period of the pixel circuit such that a previous state of the light modulator is preserved during the data loading period. In some implementations, the output node is connected to the shutter of the light modulator. In some implementations, the pixel circuit can operate in an analog mode, in which the period for which the light modulator is maintained in a particular state is based on the magnitude of the data voltage.

Particular implementations of the subject matter described in this disclosure can be implemented to realize one or more of the following potential advantages. By using a positive voltage feedback circuit in conjunction with an actuation circuit, the output voltage at an output of the actuation circuit can be boosted to an actuation voltage without the need for separate pre-charge circuitry. Furthermore, only a relatively low data voltage is needed to boost the output voltage to the actuation voltage. When the actuation circuit is utilized to drive one of the actuators of a light modulator, manipulating the voltage at the shutter of the light modulator allows preserving a previous state of the light modulator while new data is being loaded. This, in turn, allows an increase in an on-time of a light-source used for illuminating the display. A similar increase in the on-time of the light-source can be achieved by manipulating the voltages at the two actuators of the light modulator when the actuation circuit is used to drive the shutter. Additionally, analog mode operation of the pixel circuit allows the use of analog grayscale techniques for displaying images, which can reduce image artifacts.

FIG. 1A shows a schematic diagram of an example direct-view MEMS-based display apparatus 100. The display apparatus 100 includes a plurality of light modulators 102*a*-102*d* (generally light modulators 102) arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide a luminance level in an image 104. With respect to an image, a pixel corresponds to the smallest picture element defined by the resolution of image. With respect to structural components of the display apparatus 100, the term pixel refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the image can be seen by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or backlight so that each pixel can be uniformly illuminated. Transmissive direct-view displays are often built onto transparent substrates to facilitate a sandwich assembly arrangement where one substrate, containing the light modulators, is positioned over the backlight. In some implementations, the transparent substrate can be a glass substrate (sometimes referred to as a glass plate or panel), or a plastic substrate. The glass substrate may be or include, for example, a borosilicate glass, wine glass, fused silica, a soda lime glass, quartz, artificial quartz, Pyrex, or other suitable glass material.

Each light modulator 102 can include a shutter 108 and an aperture 109. To illuminate a pixel 106 in the image 104, the shutter 108 is positioned such that it allows light to pass through the aperture 109. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix coupled to the substrate and to the light modulators for controlling the movement of the shutters. The control matrix includes a series of electrical interconnects (such as interconnects 110, 112 and 114), including at least one write-enable interconnect 110 (also referred to as a scan line interconnect) per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the write-enabling voltage, VWE), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate drive voltages, which are typically higher in magnitude than the data voltages, to the light modulators 102. The application of these drive voltages results in the electrostatic driven movement of the shutters 108.

The control matrix also may include, without limitation, circuitry, such as a transistor and a capacitor associated with each shutter assembly. In some implementations, the gate of each transistor can be electrically connected to a scan line interconnect. In some implementations, the source of each transistor can be electrically connected to a corresponding data interconnect. In some implementations, the drain of each transistor may be electrically connected in parallel to an electrode of a corresponding capacitor and to an electrode of a corresponding actuator. In some implementations, the other electrode of the capacitor and the actuator associated with each shutter assembly may be connected to a common or ground potential. In some other implementations, the transistor can be replaced with a semiconducting diode, or a metal-insulator-metal switching element.

Figure 1B:
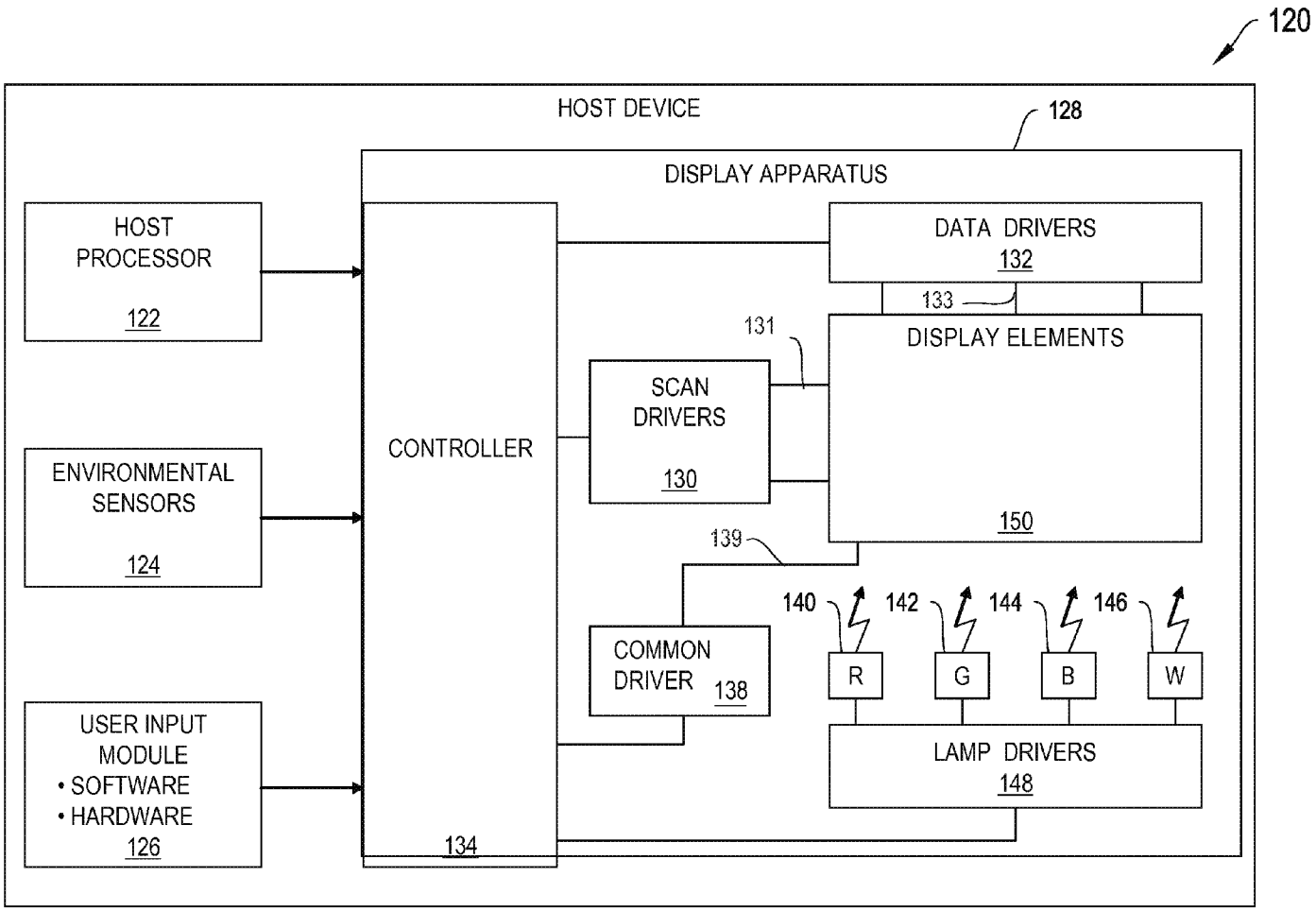
FIG. 1B shows a block diagram of an example host device.

FIG. 1B shows a block diagram of an example host device 120 (i.e., cell phone, smart phone, PDA, MP3 player, tablet, e-reader, netbook, notebook, watch, wearable device, laptop, television, or other electronic device). The host device 120 includes a display apparatus 128 (such as the display apparatus 100 shown in FIG. 1A), a host processor 122, environmental sensors 124, a user input module 126, and a power source.

The display apparatus 128 includes a plurality of scan drivers 130 (also referred to as write enabling voltage sources), a plurality of data drivers 132 (also referred to as data voltage sources), a controller 134, common drivers 138, lamps 140-146, lamp drivers 148 and an array of display elements 150, such as the light modulators 102 shown in FIG. 1A. The scan drivers 130 apply write enabling voltages to scan line interconnects 131. The data drivers 132 apply data voltages to the data interconnects 133.

In some implementations of the display apparatus, the data drivers 132 are capable of providing analog data voltages to the array of display elements 150, especially where the luminance level of the image is to be derived in analog fashion. In analog operation, the display elements are designed such that when a range of intermediate voltages is applied through the data interconnects 133, there results a range of intermediate illumination states or luminance levels in the resulting image. In some other implementations, the data drivers 132 are capable of applying only a reduced set, such as 2, 3 or 4, of digital voltage levels to the data interconnects 133. In implementations in which the display elements are shutter-based light modulators, such as the light modulators 102 shown in FIG. 1A, these voltage levels are designed to set, in digital fashion, an open state, a closed state, or other discrete state to each of the shutters 108. In some implementations, the drivers are capable of switching between analog and digital modes.

The scan drivers 130 and the data drivers 132 are connected to a digital controller circuit 134 (also referred to as the controller 134). The controller 134 sends data to the data drivers 132 in a mostly serial fashion, organized in sequences, which in some implementations may be predetermined, grouped by rows and by image frames. The data drivers 132 can include series-to-parallel data converters, level-shifting, and for some applications digital-to-analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 139. In some other implementations, the common drivers 138, following commands from the controller 134, issue voltage pulses or signals to the array of display elements 150, for instance global actuation pulses which are capable of driving and/or initiating simultaneous actuation of all display elements in multiple rows and columns of the array.

Each of the drivers (such as scan drivers 130, data drivers 132 and common drivers 138) for different display functions can be time-synchronized by the controller 134. Timing commands from the controller 134 coordinate the illumination of red, green, blue and white lamps (140, 142, 144 and 146 respectively) via lamp drivers 148, the write-enabling and sequencing of specific rows within the array of display elements 150, the output of voltages from the data drivers 132, and the output of voltages that provide for display element actuation. In some implementations, the lamps are light emitting diodes (LEDs).

The controller 134 determines the sequencing or addressing scheme by which each of the display elements can be re-set to the illumination levels appropriate to a new image 104. New images 104 can be set at periodic intervals. For instance, for video displays, color images or frames of video are refreshed at frequencies ranging from 10 to 300 Hertz (Hz). In some implementations, the setting of an image frame to the array of display elements 150 is synchronized with the illumination of the lamps 140, 142, 144 and 146 such that alternate image frames are illuminated with an alternating series of colors, such as red, green, blue and white. The image frames for each respective color are referred to as color subframes. In this method, referred to as the field sequential color method, if the color subframes are alternated at frequencies in excess of 20 Hz, the human visual system (HVS) will average the alternating frame images into the perception of an image having a broad and continuous range of colors. In some other implementations, the lamps can employ primary colors other than red, green, blue and white. In some implementations, fewer than four, or more than four lamps with primary colors can be employed in the display apparatus 128.

In some implementations, where the display apparatus 128 is designed for the digital switching of shutters, such as the shutters 108 shown in FIG. 1A, between open and closed states, the controller 134 forms an image by the method of time division gray scale. In some other implementations, the display apparatus 128 can provide gray scale through the use of multiple display elements per pixel.

In some implementations, the data for an image state is loaded by the controller 134 to the array of display elements 150 by a sequential addressing of individual rows, also referred to as scan lines. For each row or scan line in the sequence, the scan driver 130 applies a write-enable voltage to the write enable interconnect 131 for that row of the array of display elements 150, and subsequently the data driver 132 supplies data voltages, corresponding to desired shutter states, for each column in the selected row of the array. This addressing process can repeat until data has been loaded for all rows in the array of display elements 150. In some implementations, the sequence of selected rows for data loading is linear, proceeding from top to bottom in the array of display elements 150. In some other implementations, the sequence of selected rows is pseudo-randomized, in order to mitigate potential visual artifacts. And in some other implementations, the sequencing is organized by blocks, where, for a block, the data for only a certain fraction of the image is loaded to the array of display elements 150. For example, the sequence can be implemented to address only every fifth row of the array of the display elements 150 in sequence.

In some implementations, the addressing process for loading image data to the array of display elements 150 is separated in time from the process of actuating the display elements. In such an implementation, the array of display elements 150 may include data memory elements for each display element, and the control matrix may include a global actuation interconnect for carrying trigger signals, from the common driver 138, to initiate simultaneous actuation of the display elements according to data stored in the memory elements.

In some implementations, the array of display elements 150 and the control matrix that controls the display elements may be arranged in configurations other than rectangular rows and columns. For example, the display elements can be arranged in hexagonal arrays or curvilinear rows and columns.

The host processor 122 generally controls the operations of the host device 120. For example, the host processor 122 may be a general or special purpose processor for controlling a portable electronic device. With respect to the display apparatus 128, included within the host device 120, the host processor 122 outputs image data as well as additional data about the host device 120. Such information may include data from environmental sensors 124, such as ambient light or temperature; information about the host device 120, including, for example, an operating mode of the host or the amount of power remaining in the host device's power source; information about the content of the image data; information about the type of image data; and/or instructions for the display apparatus 128 for use in selecting an imaging mode.

In some implementations, the user input module 126 enables the conveyance of personal preferences of a user to the controller 134, either directly, or via the host processor 122. In some implementations, the user input module 126 is controlled by software in which a user inputs personal preferences, for example, color, contrast, power, brightness, content, and other display settings and parameters preferences. In some other implementations, the user input module 126 is controlled by hardware in which a user inputs personal preferences. In some implementations, the user may input these preferences via voice commands, one or more buttons, switches or dials, or with touch-capability. The plurality of data inputs to the controller 134 direct the controller to provide data to the various drivers 130, 132, 138 and 148 which correspond to optimal imaging characteristics.

The environmental sensor module 124 also can be included as part of the host device 120. The environmental sensor module 124 can be capable of receiving data about the ambient environment, such as temperature and or ambient lighting conditions. The sensor module 124 can be programmed, for example, to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2B:
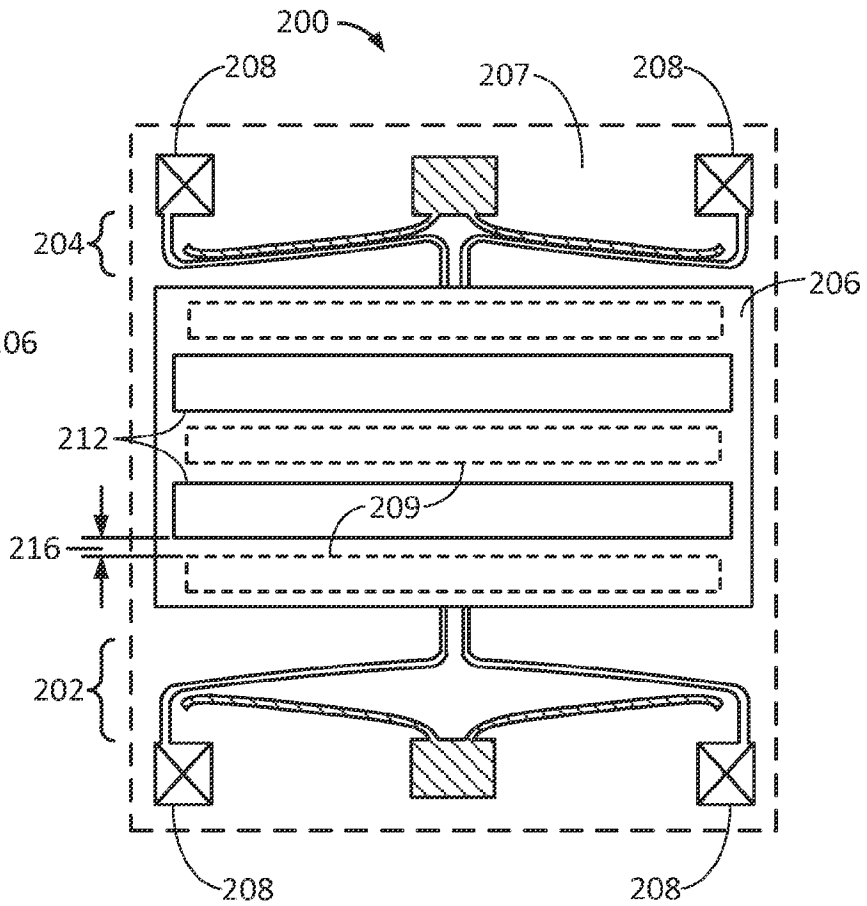
FIGS. 2A and 2B show views of an example dual actuator shutter assembly.
Figure 2A:
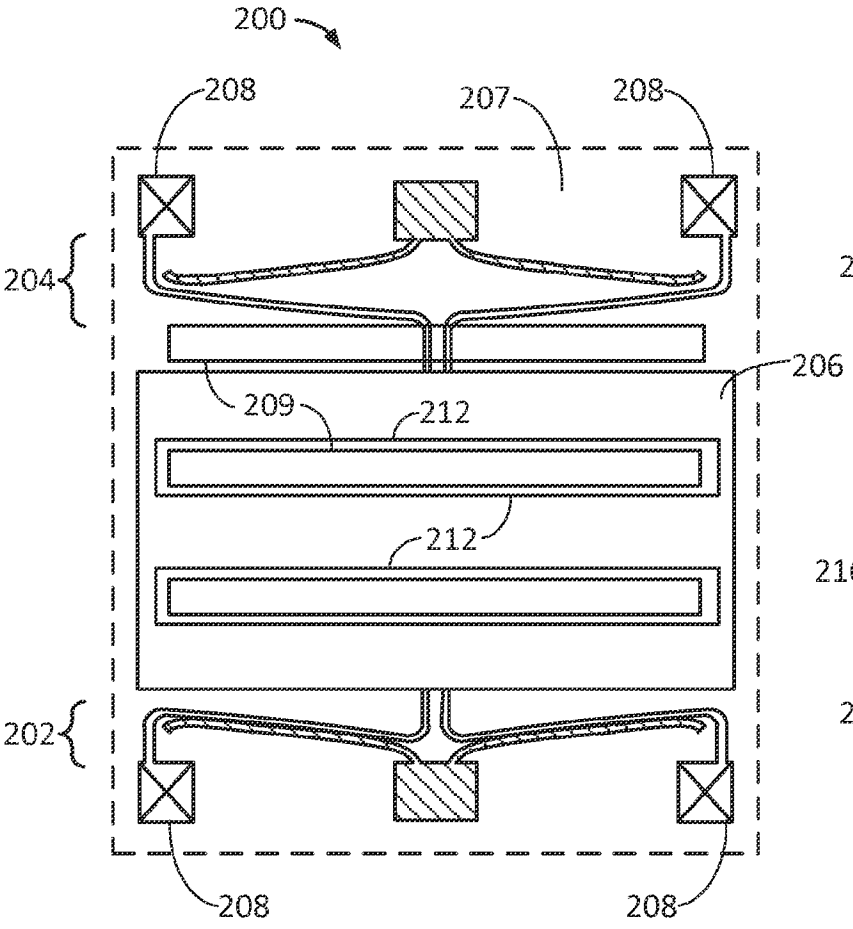

FIGS. 2A and 2B show views of an example dual actuator shutter assembly 200. The dual actuator shutter assembly 200, as depicted in FIG. 2A, is in an open state. FIG. 2B shows the dual actuator shutter assembly 200 in a closed state. The shutter assembly 200 includes actuators 202 and 204 on either side of a shutter 206. Each actuator 202 and 204 is independently controlled. A first actuator, a shutter-open actuator 202, serves to open the shutter 206. A second opposing actuator, the shutter-close actuator 204, serves to close the shutter 206. Each of the actuators 202 and 204 can be implemented as compliant beam electrode actuators. The actuators 202 and 204 open and close the shutter 206 by driving the shutter 206 substantially in a plane parallel to an aperture layer 207 over which the shutter is suspended. The shutter 206 is suspended a short distance over the aperture layer 207 by anchors 208 attached to the actuators 202 and 204. Having the actuators 202 and 204 attach to opposing ends of the shutter 206 along its axis of movement reduces out of plane motion of the shutter 206 and confines the motion substantially to a plane parallel to the substrate (not depicted).

In the depicted implementation, the shutter 206 includes two shutter apertures 212 through which light can pass. The aperture layer 207 includes a set of three apertures 209. In FIG. 2A, the shutter assembly 200 is in the open state and, as such, the shutter-open actuator 202 has been actuated, the shutter-close actuator 204 is in its relaxed position, and the centerlines of the shutter apertures 212 coincide with the centerlines of two of the aperture layer apertures 209. In FIG. 2B, the shutter assembly 200 has been moved to the closed state and, as such, the shutter-open actuator 202 is in its relaxed position, the shutter-close actuator 204 has been actuated, and the light blocking portions of the shutter 206 are now in position to block transmission of light through the apertures 209 (depicted as dotted lines).

Each aperture has at least one edge around its periphery. For example, the rectangular apertures 209 have four edges. In some implementations, in which circular, elliptical, oval, or other curved apertures are formed in the aperture layer 207, each aperture may have only a single edge. In some other implementations, the apertures need not be separated or disjointed in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through the apertures 212 and 209 in the open state, the width or size of the shutter apertures 212 can be designed to be larger than a corresponding width or size of apertures 209 in the aperture layer 207. In order to effectively block light from escaping in the closed state, the light blocking portions of the shutter 206 can be designed to overlap the edges of the apertures 209. FIG. 2B shows an overlap 216, which in some implementations can be predefined, between the edge of light blocking portions in the shutter 206 and one edge of the aperture 209 formed in the aperture layer 207.

The electrostatic actuators 202 and 204 are designed so that their voltage-displacement behavior provides a bi-stable characteristic to the shutter assembly 200. For each of the shutter-open and shutter-close actuators, there exists a range of voltages below the actuation voltage, which if applied while that actuator is in the closed state (with the shutter being either open or closed), will hold the actuator closed and the shutter in position, even after a drive voltage is applied to the opposing actuator. The minimum voltage needed to maintain a shutter's position against such an opposing force is referred to as a maintenance voltage Vm.

Electrical bi-stability in electrostatic actuators, such as actuators 202 and 204, can arise from the fact that the electrostatic force across an actuator is a function of position as well as voltage. The beams of the actuators in the shutter assembly 200 can be implemented to act as capacitor plates. The force between capacitor plates is proportional to 1/d2 where d is the local separation distance between capacitor plates. When the actuator is in a closed state, the local separation between the actuator beams is very small. Thus, the application of a small voltage can result in a relatively strong force between the actuator beams of the actuator in the closed state. As a result, a relatively small voltage, such as Vm, can keep the actuator in the closed state, even if other elements exert an opposing force on the actuator.

In dual-actuator light modulators, the equilibrium position of the light modulator can be determined by the combined effect of the voltage differences across each of the actuators. In other words, the electrical potentials of the three terminals, namely, the shutter open drive beam, the shutter close drive beam, and the load beams, as well as modulator position, can be considered to determine the equilibrium forces on the modulator.

For an electrically bi-stable system, a set of logic rules can describe the stable states and can be used to develop reliable addressing or digital control schemes for a given light modulator. Referring to the shutter assembly 200 as an example, these logic rules are as follows:

Let Vs be the electrical potential on the shutter or load beam. Let Vo be the electrical potential on the shutter-open drive beam. Let Vc be the electrical potential on the shutter-close drive beam. Let the expression |Vo−Vs| refer to the absolute value of the voltage difference between the shutter and the shutter-open drive beam. Let Vm be the maintenance voltage. Let Vat be the actuation threshold voltage, i.e., the voltage to actuate an actuator absent the application of Vm to an opposing drive beam. Let Vmax be the maximum allowable potential for Vo and Vc. Let Vm<Vat<Vmax. Then, assuming Vo and Vc remain below Vmax:

$$\text{If } |Vo-Vs|<Vm \text{ and } |Vc-Vs|<Vm \quad \text{(rule 1)}$$

Then the shutter will relax to the equilibrium position of its mechanical spring.

$$\text{If } |Vo-Vs|>Vm \text{ and } |Vc-Vs|>Vm \quad \text{(rule 2)}$$

Then the shutter will not move, i.e., it will hold in either the open or the closed state, whichever position was established by the last actuation event.

$$\text{If } |Vo-Vs|>Vat \text{ and } |Vc-Vs|<Vm \quad \text{(rule 3)}$$

Then the shutter will move into the open position.

$$\text{If } |Vo-Vs|<Vm \text{ and } |Vc-Vs|>Vat \quad \text{(rule 4)}$$

Then the shutter will move into the closed position.

Following rule 1, with voltage differences on each actuator near zero, the shutter will relax. In many shutter assemblies, the mechanically relaxed position is only partially open or closed, and so this voltage condition is usually avoided in an addressing scheme.

The condition of rule 2 makes it possible to include a global actuation function into an addressing scheme. By maintaining a shutter voltage which provides beam voltage differences that are at least the maintenance voltage, Vm, the absolute values of the shutter open and shutter closed potentials can be altered or switched in the midst of an addressing sequence over wide voltage ranges (even where voltage differences exceed Vat) with no danger of unintentional shutter motion.

The conditions of rules 3 and 4 are those that are generally targeted during the addressing sequence to ensure the bi-stable actuation of the shutter.

The maintenance voltage difference, Vm, can be designed or expressed as a certain fraction of the actuation threshold voltage, Vat. For systems designed for a useful degree of bi-stability, the maintenance voltage can exist in a range between about 20% and about 80% of Vat. This helps ensure that charge leakage or parasitic voltage fluctuations in the system do not result in a deviation of a set holding voltage out of its maintenance range—a deviation which could result in the unintentional actuation of a shutter. In some systems, an exceptional degree of bi-stability or hysteresis can be provided, with Vm existing over a range of about 2% and about 98% of Vat. In these systems, however, care must be taken to ensure that an electrode voltage condition of |Vc−Vs| or |Vo−Vs| being less than Vm can be reliably obtained within the addressing and actuation time available.

In some implementations, the first and second actuators of each light modulator are coupled to a latch or a drive circuit to ensure that the first and second states of the light modulator are the only two stable states that the light modulator can assume.

Figure 3:
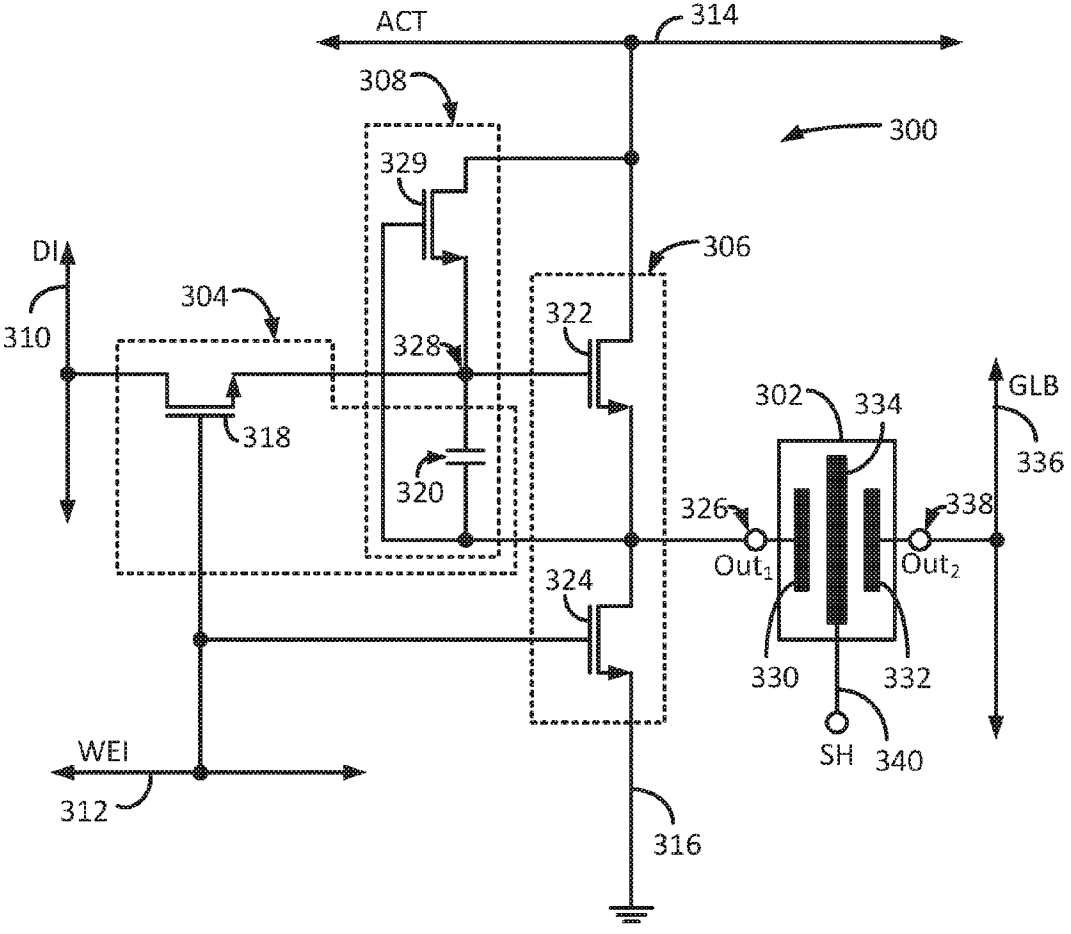
FIG. 3 shows a first example pixel circuit that can be implemented for controlling a light modulator.

FIG. 3 shows a first example pixel circuit 300 that can be implemented for controlling a light modulator 302. In particular, the pixel circuit 300 can be used to control dual actuator light modulators, such as the light modulator 200 shown in FIGS. 2A and 2B. The pixel circuit 300 can be part of a control matrix that controls an array of pixels that incorporate light modulators similar to the light modulator 302.

The pixel circuit 300 includes a data loading circuit 304, an actuation circuit 306, and a voltage feedback circuit 308. The data loading circuit 304 is configured to load a data voltage from the data interconnect 310. The actuation circuit 306 is configured to provide an actuation voltage to the light modulator 302 based on the data voltage. The voltage feedback circuit 308 is configured to provide a positive feedback voltage from the output of the actuation circuit 306 to an input of the actuation circuit 306.

The pixel circuit 300 receives voltage signals from various interconnects. For example, as mentioned above, the data interconnect 310 provides a data voltage that is to be stored at the pixel circuit 300. The data interconnect 310 can be common to all pixel circuits associated with pixels in the same column of a pixel array. The pixel circuit 300 can receive a write enable voltage from a write enable interconnect 312, also referred to as scan line. The write enable interconnect 312 can be common to all pixel circuits associated with pixels in the same row of the pixel array. The pixel circuit 300 is also coupled to an actuation voltage interconnect 314, which provides the pixel circuit 300 with an actuation voltage. In addition, a common interconnect 316 provides a common or ground terminal to the pixel circuit 300.

The data loading circuit 304 includes a data loading transistor 318 and a data storage capacitor 320. The drain/source terminal of the data loading transistor 318 is coupled to the data interconnect 310, while the source/drain terminal of the data loading transistor 318 is coupled to the data storage capacitor 320. The gate terminal of the data loading transistor 318 is coupled to the write enable interconnect 312. The data loading transistor 318 can operate as a switch and can be selectively switched ON or OFF by the write enable voltage on the write enable interconnect 312. For example, the write enable voltage on the write enable interconnect 312 can be appropriately selected to switch ON the data loading transistor 318, causing the data voltage appearing on the data interconnect 310 to be stored in the data storing capacitor 320.

The actuation circuit 306 includes an actuation transistor 322 and a discharge transistor 324. The actuation transistor 322 can operate as a switch and can provide a charge path from the actuation voltage interconnect 314 to a first output node 326 of the pixel circuit 300. The discharge transistor 324 also can operate as a switch and can provide a discharge path between the first output node 326 and the common interconnect 316. The gate terminal of the actuation transistor 322 is coupled to an input node 328, which is also coupled to the source/drain terminal of the data loading transistor 318 and to the data storage capacitor 320. The actuation transistor 322 can switch ON or OFF based on the data voltage loaded by the data loading circuit 304 and stored in the data storage capacitor 320. If the data voltage is sufficient to switch the actuation transistor ON, then the first output node 326 is charged to a voltage that is substantially equal to the actuation voltage on the actuation voltage interconnect 314. The gate terminal of the discharge transistor 324 is coupled to the write enable interconnect 312 (which is also coupled to the gate terminal of the data loading transistor 318). If the voltage on the write enable interconnect 312 is sufficient to switch ON the discharge transistor 324, then the first output node 326 is discharged to a ground or common voltage.

The voltage feedback circuit 308 includes a feedback transistor 329 and the data storage capacitor 320 (which is also included in the data loading circuit 304, as discussed above). The voltage feedback circuit 308 provides a positive voltage feedback from the first output node 326 to the input node 328 of the actuation circuit 306. The drain terminal and the source terminal of the feedback transistor 329 are coupled to the actuation voltage interconnect 314 and the input node 328, respectively. The gate terminal of the feedback transistor is coupled to the first output node 326. The data storage capacitor 320 is coupled between the input node 328 and the first output node 326.

The voltage feedback circuit 308 provides a positive voltage feedback from the first output node 326 to the input node 328. Specifically, the voltage feedback circuit 308 provides a positive voltage feedback from the source terminal of the actuation transistor 322 to the gate terminal of the actuation transistor 322. For example, when the actuation voltage on the actuation interconnect 314 is increased and the data voltage stored on the data storage capacitor 320 is greater than the threshold voltage of the actuation transistor 322, the actuation transistor 322 switches ON. This causes the voltage at the first output node 326 to increase. As the gate terminal of the feedback transistor 329 is coupled to the first output node 326, the feedback transistor 329 also switches ON. This results in the input node 328, i.e., the gate terminal of the actuation transistor 322, being pulled toward the actuation voltage. This increases the voltage at the gate terminal of the actuation transistor 322, which, in turn, causes the actuation transistor 322 to further pull the first output node 326 towards the actuation voltage.

Furthermore, the data storage capacitor 320, which is coupled between the source terminal and the gate terminal of the actuation transistor 322, is a floating capacitor. Thus, as the voltage at one terminal of the data storage capacitor 320, coupled to the first output node 326, increases by a certain magnitude, the voltage at the other terminal of the data storage capacitor 320, coupled to the input terminal 328, also increases by about the same magnitude.

In this manner, the voltage feedback circuit 308 allows the first output node 326 to be charged to a voltage that is substantially greater than the data voltage stored in the data storage capacitor 320, and that is substantially equal to the actuation voltage. Thus, the first output node 326 can be charged to the actuation voltage without the need for a separate pre-charge circuit. In some implementations, even a small data voltage stored in the data storage capacitor 320 can be sufficient to charge the first output node 326 to the actuation voltage. For example, a data voltage equal to or greater than the threshold voltage of the first actuation transistor 322 can be sufficient to switch ON the actuation transistor. Switching ON the actuation transistor 322 can cause the feedback transistor 329 to switch ON and to provide a positive voltage feedback from the source terminal to the gate terminal of the actuation transistor 322, resulting in the first output node 326 to charge to the actuation voltage.

This means that the data interconnect 310 need to only be charged to a voltage that can cause the data storage capacitor 320 to be charged to a voltage that is at or slightly greater than the threshold voltage of the actuation transistor 322. By reducing the magnitude of the voltage needed at the data interconnect 310 to actuate the light modulator 302, power consumption can be reduced.

As mentioned above, the first output node 326 is coupled to the light modulator 302. Specifically, the first output node 326 is coupled to a first actuator 330. The light modulator 302 also includes a second actuator 332 and a shutter terminal 334. The second actuator 332 can be coupled to a global interconnect 336 via a second output node 338. The global interconnect 336, in some implementations, is coupled to the second actuators of all light modulators. In some implementations, the shutter terminal 334 is coupled to a shutter interconnect 340, which is used to supply a shutter voltage to the shutter terminal 334. A shutter voltage, similar to the shutter voltage $V_s$ discussed above in relation to the shutter assembly 200 shown in FIGS. 2A and 2B, can be provided to the shutter terminal 334 of the light modulator 302 via the shutter interconnect 340. In some implementations, in response to applying a voltage $V_{OUT1}$ to the first actuator 330 via the first output node 326 and applying a voltage $V_{OUT2}$ to the second actuator 332 via the global interconnect 336 such that $|V_{OUT1}-V_s|>V_{at}$ and $|V_{OUT2}-V_s|<V_m$, the shutter 334 will move to an OPEN state (as described in rule 3 discussed above in relation to FIGS. 2A and 2B), where $V_{at}$ is the actuation threshold voltage and $V_m$ is the maintenance voltage. Conversely, if $|V_{OUT2}-V_s|>V_{at}$ and $|V_{OUT1}-V_s|<V_m$, the shutter 334 will move to the CLOSED state (see rule 4 discussed above). Additional details of the configuration and the operation of the light modulator 302 in relation to the pixel circuit 300 are discussed further below.

Figure 4:
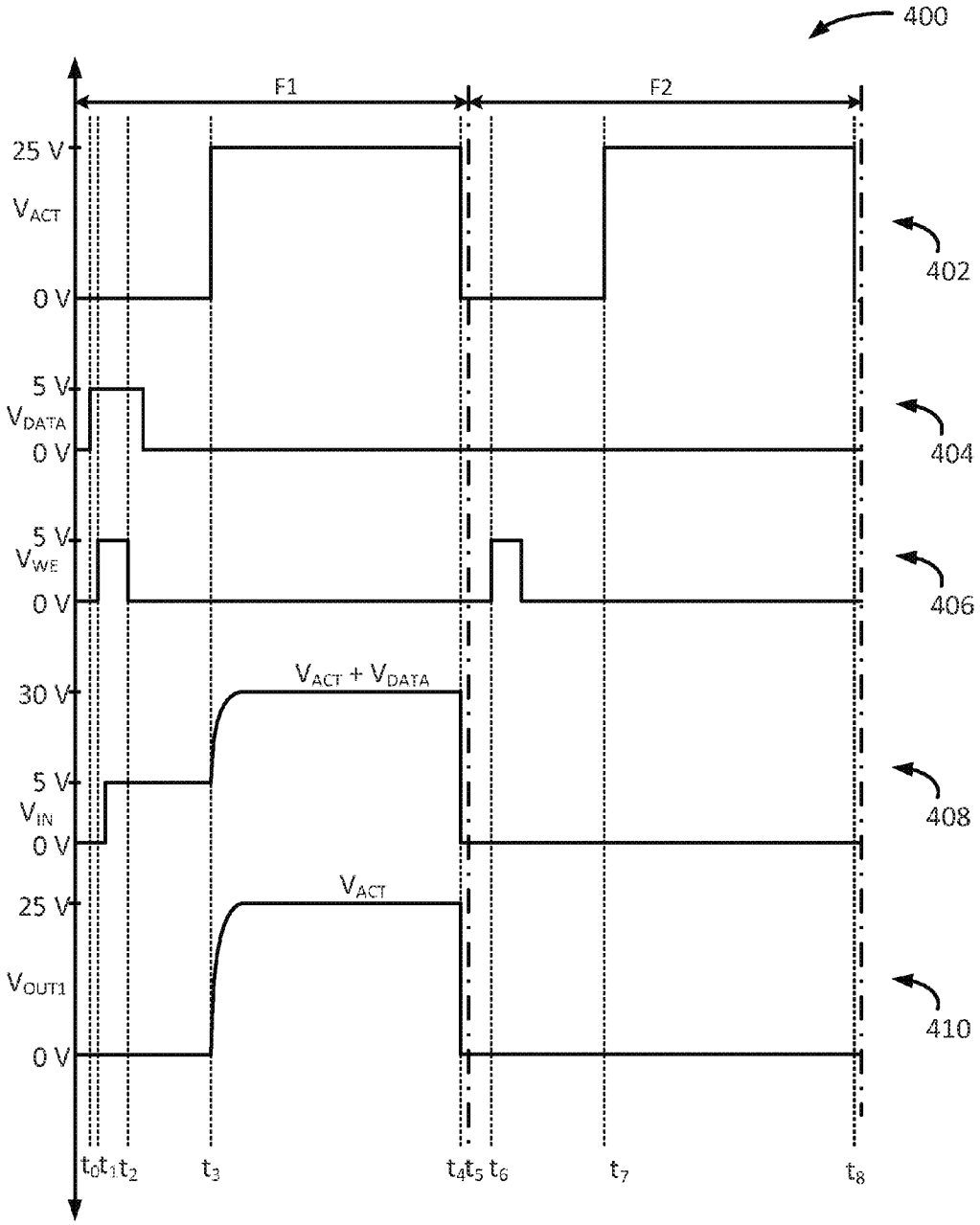
FIG. 4 shows an example timing diagram for the pixel circuit shown in FIG. 3.

FIG. 4 shows an example timing diagram 400 for the pixel circuit 300 shown in FIG. 3. In particular, the timing diagram 400 shows voltage levels at various nodes of the pixel circuit 300 over two image frame periods F1 and F2. $V_{ACT}$ 402 represents the actuation voltage on the actuation voltage interconnect 314, $V_{DATA}$ 404 represents the data voltage at the data interconnect 310, $V_{WE}$ 406 represents the write enable voltage on the write enable interconnect 312, $V_{IN}$ 408 represents the input node voltage at the input node 328, and $V_{OUT1}$ 410 represents the output voltage at the first output node 326. Each voltage shown in FIG. 4 generally swings between a high and a low value. But the high and low values for any one voltage may or may not be equal to the high and low values for another voltage.

The magnitudes of voltages shown in FIG. 4 are only examples, and different implementations may utilize different magnitudes. For example, in some implementations, the magnitudes of one or more voltages shown in FIG. 4 may be based on the particular characteristics of the transistors employed in the pixel circuit 300. In some implementations, for example, the magnitude of the low values for the data voltage $V_{DATA}$ 404, write enable voltage $V_{WE}$ 406, and the actuation voltage $V_{ACT}$ 402 may be around 0 V, while the magnitude of the high values for $V_{DATA}$ 404 and $V_{WE}$ 406 may be about 3 V to about 7 V, and the magnitude of the high values for $V_{ACT}$ 402 may be about 20 V to about 40 V. The rise and fall times for various voltages in the timing diagram 400 are merely for illustration, and may not represent the actual rise and fall times of these voltages.

The first frame period F1 begins with a data loading period. The actuation voltage $V_{ACT}$ 402, the data voltage $V_{DATA}$ 404, and the write enable voltage $V_{WE}$ 406 are maintained at a low voltage that is, for example, substantially equal to 0 V or the ground voltage. This results in the input node voltage $V_{IN}$ 408 and the output voltage $V_{OUT1}$ 410 being pulled to a voltage that is substantially equal to the ground voltage. At time $t_0$, the data voltage can be loaded onto the data interconnect 310. This causes the data voltage $V_{DATA}$ 404 to increase to about 5 V. Thus, the voltage at one of the source/drain terminals of the data loading transistor 318 is raised to 5 V. The gate terminal of the data loading transistor 318 is maintained at ground voltage. Therefore, the data loading transistor 318 is in an OFF state, and the input node 328 is isolated from the data interconnect 310.

At time $t_1$, the write enable voltage $V_{WE}$ 406 on the write enable interconnect 312 is raised such that both the data loading transistor 318 and the discharge transistor 324 switch ON. For example, as shown in FIG. 4, the write enable voltage $V_{WE}$ 406 is raised to about 5 V. The switching ON of the discharge transistor 324 causes the first output node 326 to completely discharge. In other words, the switching ON of the discharge transistor causes the output voltage $V_{OUT1}$ to be pulled to about 0 V. The switching ON of the data loading transistor 318 causes the data storage capacitor 320 (one terminal of which is coupled to the input node 328) to be charged or discharged to the data voltage $V_{DATA}$ 404. As the initial voltage across the data storage capacitor 320 is substantially zero volts and the data voltage $V_{DATA}$ 404 is substantially equal to about 5 V, switching ON the data loading transistor 318 causes the data storage capacitor to charge to a voltage that is substantially equal to the data voltage $V_{DATA}$ 404. Thus, as shown in FIG. 4, after time $t_1$, the input node voltage $V_{IN}$ 408 increases to about 5 V.

It should be noted that even though the voltage difference between the gate and source terminals of the actuation transistor 322 is about 5 V (which can be assumed to be greater than the threshold voltage of the actuation transistor 322), the actuation transistor 322 does not conduct any current. This is because the actuation voltage $V_{ACT}$ 402, which is applied to the drain terminal of the actuation transistor 322, is at about 0 V; and the first output node voltage $V_{OUT1}$ 410, which is applied to the source terminal of the actuation transistor 322 is also at about 0V. This means that the voltage difference between the drain and source terminals of the actuation transistor 322 is about 0 V, resulting in the actuation transistor 322 not conducting any current.

At time $t_2$, the write enable voltage $V_{WE}$ 406 is reduced such that both the data load transistor 318 and the discharge transistor 324 are switched OFF. For example, as shown in FIG. 4, the write enable voltage $V_{WE}$ 406 is reduced to about 0 V. As the data loading transistor 318 is switched OFF, the input node 328 is isolated from the data interconnect 310. Thus, the data voltage stored in the data storage capacitor 320 can be isolated from any changes in voltage on the data interconnect 310. These changes may occur, for example, when the data interconnect 310 is utilized to load data into pixel circuits associated with pixels in other rows. Thus, the data voltage $V_{DATA}$ 404 reducing to about 0 V at time $t_2$ does not affect the input voltage $V_{IN}$ 408 at the input node 328. The discharge transistor 324 is also switched OFF, which isolates the first output node 326 from the ground terminal 316.

While not shown in FIG. 4, the data loading period also includes loading data voltages for pixels in other rows. Thus, after time $t_2$, when the data voltage has been loaded into the pixel circuit 300, write enable voltages are sequentially applied to write enable interconnects of other rows to store respective data voltages in the pixel circuits of those rows. The data loading period ends when the actuation voltage on the actuation voltage interconnect 314 is raised so that the light modulator 302 can be actuated based on the data voltage stored in the data storage capacitor 320.

The actuation period begins at time $t_3$. At this time, the actuation voltage $V_{ACT}$ 402 on the actuation voltage interconnect 314 is increased to about 25 V. Thus, the drain terminal of the actuation transistor 322, which is coupled to the actuation voltage interconnect 314, is at 25 V. This causes the actuation transistor 322 to conduct current and charge the first output node 326. As discussed above, the increase in the voltage at the first output node 326 causes the feedback transistor 329 to switch ON. The switching ON of the feedback transistor 329, in turn, causes the voltage at the input node 328, i.e., the gate terminal of the actuation transistor 322 to increase. In addition, the data storage capacitor 320, which is coupled between the gate and source terminals of the actuation transistor 322, is a floating capacitor. Therefore, any increase in voltage at the source terminal (i.e., the first output node 326) causes a substantially similar increase in the voltage at the gate terminal (i.e., the input node 328).

The combination of the actuation transistor 322 switching ON and the positive voltage feedback provided by the feedback circuit 308 causes the first output node 326 to be charged to a voltage that is substantially equal to the actuation voltage $V_{ACT}$ 402. The input node 328, which is coupled to one terminal of the floating data storage capacitor 320 (the second terminal of which is coupled to the first output node 326), is pulled to a voltage that is about $V_{DATA}$ volts greater than the actuation voltage $V_{ACT}$ 402.

As shown in FIG. 3, the first output voltage $V_{OUT1}$ 410 is applied to the first actuator 330 of the light modulator 302. Based on the voltages applied to the shutter 334 and the second output node 338, the light modulator 302 may switch to an OPEN or CLOSED state. In some implementations, if the voltages applied to the shutter 334 and the second output node 338 are equal to about 0V the shutter 334 will switch to an OPEN state. In some implementations, the period for which the actuation voltage $V_{ACT}$ 402 is maintained at a high voltage (such as 25 V) coincides the period for which the backlight is illuminated.

The actuation period ends at time $t_4$. At this time, the actuation voltage $V_{ACT}$ 402 is brought low to about 0 V. This causes both the input node voltage $V_{IN}$ 408 and the first output node voltage $V_{OUT1}$ 410 to be pulled to about 0 V. As a result, a low voltage of about 0 V is provided to the first actuator 330.

The image frame period F2 begins at time $t_5$ with a data loading period. In contrast with the image frame period F1, during which a high data voltage appears on the data interconnect 310, in image frame period F2 a low data voltage appears on the data interconnect 310. At time $t_6$, the write enable voltage $V_{WE}$ 406 is pulled high to about 5 V. This causes both the data loading transistor 318 and the discharge transistor 324 to switch ON. As the data voltage $V_{DATA}$ 404 at the data interconnect 310 is about 0 V, the data storage capacitor 320 is discharged such that the input node voltage $V_{IN}$ 408 at the input node 328 is substantially equal to 0V. Furthermore, the switching ON of the discharge transistor causes the first output node voltage $V_{OUT1}$ 410 to be pulled to about 0 V.

As both the input node 328 and the first output node 326 are at about 0 V, the data storage capacitor 320 is in a discharged state with the voltage across its terminals being maintained at about 0 V.

The data loading period ends and the actuation period begins at time $t_7$. At this time, the actuation voltage $V_{ACT}$ 402 is raised to about 25 V. This means that the drain terminal of the actuation transistor 322 is also raised to about 25 V. The gate and source terminals of the actuation transistor 322 are coupled to the input node 328 and the first output node 326, respectively. As mentioned above, both the input node 328 and the first output node 326 are at about 0 V. Thus, the voltage difference between the gate and source terminals of the actuation transistor 322 is below its threshold voltage. As a result, the actuation transistor 322 remains in the OFF state. Thus, the first output node voltage $V_{OUT1}$ 410 is also maintained at 0 V. This means that 0 V is provided to the first actuator 330 of the light modulator 302. Based on the voltages applied to the shutter 334 and the second output node 338, the light modulator 302 may switch to an OPEN or a CLOSED state.

In some implementations, the voltage $V_s$ at the shutter 334 can be operated in at least two ways. For example, in some implementations, the voltage $V_s$ at the shutter 334 can be maintained at constant voltage (such as 0 V) while the voltages $V_{OUT1}$ and $V_{OUT2}$ can be appropriately varied to attain the desired state of the light modulator 302. Such an operation of the pixel circuit 300 and the light modulator 302 is discussed below in relation to FIGS. 5-6L. In some other implementations, the voltage $V_s$ at the shutter 334 also can be varied along with varying the voltages $V_{OUT1}$ and $V_{OUT2}$ to attain the desired state of the light modulator 302. In some implementations, varying the voltage on the shutter 334 at appropriate times can advantageously increase the amount of time during an image frame period for which a backlight or light source can remain illuminated. Such an operation of the pixel circuit 300 and the light modulator 302 is discussed below in relation to FIGS. 7-8L.

Figure 5:
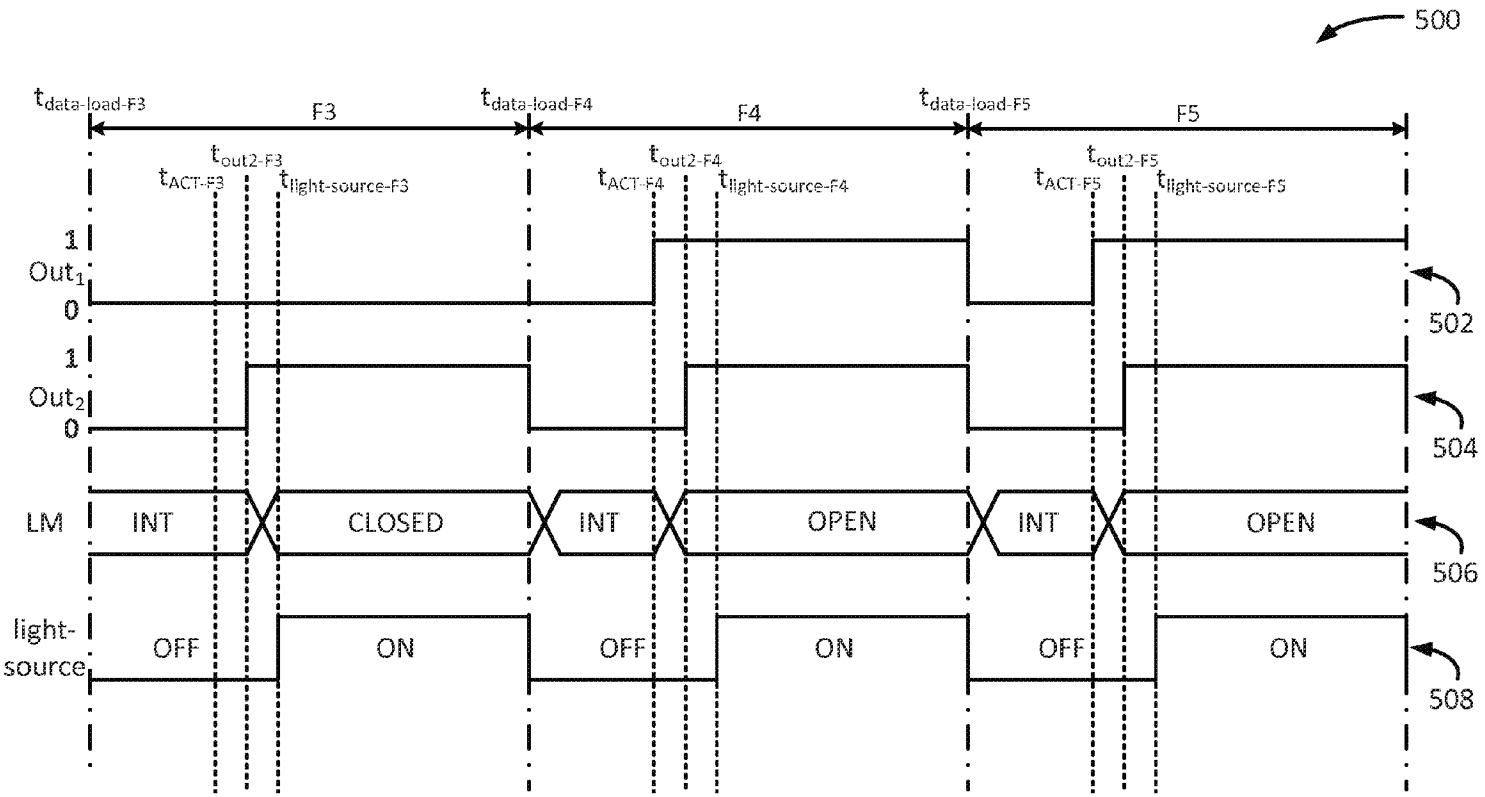
FIG. 5 shows another example timing diagram for the pixel circuit shown in FIG. 3.

FIG. 5 shows another example timing diagram 500 for the pixel circuit 300 shown in FIG. 3. In particular, FIG. 5 shows the voltage state 502 of the first output node $Out_1$ 326, the voltage state 504 of the second output node $Out_2$ 338, the voltage state 506 of the light modulator 302, and the voltage state 510 of a light source used for illuminating the array of light modulators such as the light modulator 302. For the sake of simplicity, the voltage states '0' and '1' associated with the first output node 326 and the second output node 338 represent non-actuated and actuated voltage states. For example, referring to the example timing diagram shown in FIG. 4, the voltage state '0' can represent a voltage of about 0 V, and the voltage state '1' can represent a voltage of about 25 V (the actuation voltage). Thus, when the voltage state of the first output node 326 is '0', this means that the first output node 326 is at a voltage of about 0 V, and when the voltage state is '1' then the first output node 326 is at a voltage of about 25 V. The voltages of 0 V and 25 V corresponding to the voltage states '0' and '1', respectively, are merely examples, and different implementations may utilize different voltages. In some implementations, for example, the voltage state '0' may correspond to a voltage between about 0 V to about 3 V. In some implementations, for example, the voltage state '1' may correspond to a voltage between about 10 V and about 40 V.

As discussed above in relation to FIGS. 3 and 4, the voltage at the first output node 326 is determined by the pixel circuit 300. Thus, for each pixel, the voltage state 502 of the first output node 326 is determined by the output of its respective pixel circuit 300. The voltage at the second output node 338, however, is coupled to the global interconnect 336. This means that the voltage state 504 of the second output node 338 shown in FIG. 5 represents the voltage state of the second output node of all pixels.

The light modulator (LM) can switch between an OPEN, a CLOSED and an intermediate (INT) state. The light modulator 302 state can be based on the voltage states of the first output node 326, the second output node 338, and the state of the shutter 334. In the example shown in FIG. 5, the shutter 334 is maintained at a substantially constant voltage. For example, the shutter 334 can be maintained at about 0 V. Thus, if the first output node 326, which is coupled to the first actuator 330, is in voltage state '1', while the second output node 338, which is coupled to the second actuator 332, is in voltage state '0', then the shutter would be pulled towards the first actuator 330. In the reverse condition, i.e., the first output node 326 being in voltage state '0' and the second output node 338 being in voltage state '1', the shutter 334 would be pulled towards the second actuator 332. In addition, if the voltage states of both the first output node 326 and the second output node 338 are the same (i.e., both are in voltage state '0' or in voltage state '1'), then the shutter 334 would remain in an intermediate or equilibrium state.

In the timing diagram 500 shown in FIG. 5, it is assumed that the first actuator 330 is an OPEN state actuator while the second actuator 332 is a CLOSED state actuator. This means that when the shutter 334 is pulled towards the first actuator 330, the light modulator moves to (or remains in) an OPEN state, and when the shutter is pulled towards the second actuator 332, the light modulator is moved to (or remains in) a CLOSED state. However, a person having ordinary skill in the art will readily understand that in some implementations, the first actuator 330 could be a CLOSED state actuator while the second actuator 332 could be an OPEN state actuator.

The light source state 508 shows that the light source can switch between an ON and an OFF state. In the ON state the light source emits light, while in the OFF state the light source does not emit light. While the color of the light source is not specified in FIG. 5, it is understood that the light source can include light emitters of one or more colors. In some implementations, the light source can be similar to the lamp 105 shown in FIG. 1A.

The timing diagram 500 includes three image frame periods F3, F4, and F5. In some implementations, the image frame periods F3, F4, and F5 can represent subframe periods of an image frame. The image frame periods F3, F4, and F5 can be similar to the image frame periods F1 and F2 shown in FIG. 4, in that like the image frame periods F1 and F2, the image frame periods F3, F4, and F5 also include data loading periods and actuation periods. For example, in each of the image frame periods F3, F4, and F5, the data loading period begins at time $t_{data\text{-}load\text{-}F3}$, $t_{data\text{-}load\text{-}F4}$, and $t_{data\text{-}load\text{-}F5}$, respectively, and ends at time $t_{ACT\text{-}F3}$, $t_{ACT\text{-}F4}$, and $t_{ACT\text{-}F5}$, respectively. Furthermore, for each of the image frame periods F3, F4, and F5, the actuation period begins at $t_{ACT\text{-}F3}$, $t_{ACT\text{-}F4}$, and $t_{ACT\text{-}F5}$, respectively, and ends at the beginning of the subsequent data loading period for the following image frame period. Time instants $t_{ACT\text{-}F3}$, $t_{ACT\text{-}F4}$, and $t_{ACT\text{-}F5}$ shown in FIG. 5 can be similar to the time instants $t_3$ and $t_7$, shown in FIG. 4, at which times the actuation periods for image frame periods F1 and F2, respectively, begin. Time instants $t_{data\text{-}load\text{-}F3}$, $t_{data\text{-}load\text{-}F4}$, and $t_{data\text{-}load\text{-}F5}$ can be similar to the beginning of the frame period F1 and time instant $t_5$ shown in FIG. 4.

The actuation period within each image frame period F3, F4, and F5 also can include times $t_{out2}$ and $t_{light\text{-}source}$ each occurring after $t_{ACT}$. The time $t_{out2}$ indicates the time at which the voltage state of the second output node 338 can be switched from '0' to '1' as discussed further below. A time delay is inserted between $t_{ACT}$ and $t_{out2}$ to allow the shutter 344 sufficient time to move towards the first actuator 330 if the first output node 326 is in voltage state '1'. The time $t_{light\text{-}source}$ indicates the time when the state of the light-source can be switched from the OFF state to the ON state. A time delay is inserted between the $t_{out2}$ and $t_{light\text{-}source}$ to allow the shutter 334 sufficient time to move towards the second actuator 332 if the second output node 338 were in voltage state '1'.

FIGS. 6A-6L show the state of the light modulator 302 at various instances in the example timing diagram shown in FIG. 5. In particular, FIGS. 6A-6D show the position of the shutter 344 at times $t_{data\text{-}load\text{-}F3}$, $t_{ACT\text{-}F3}$, $t_{out2\text{-}F3}$ and $t_{light\text{-}source\text{-}F3}$ during the image frame period F3; FIGS. 6E-6H shows the position of the shutter 344 at times $t_{data\text{-}load\text{-}F4}$, $t_{ACT\text{-}F4}$, $t_{out2\text{-}F4}$ and $t_{light\text{-}source\text{-}F4}$ during the image frame period F4; and FIGS. 6I-6L shows the position of the shutter 344 at times $t_{data\text{-}load\text{-}F5}$, $t_{ACT\text{-}F5}$, $t_{out2\text{-}F5}$ and $t_{light\text{-}source\text{-}F5}$ during the image frame period F5. The light modulator 302 shown in FIGS. 6A-6L can represent the dual actuator light modulator 200 shown in FIGS. 2A and 2B. For example, the first actuator 330 and the second actuator 332 can represent the first actuator 202 and the second actuator 204 shown in FIGS. 2A and 2B. Furthermore, the first actuator 330 can be a shutter-open actuator similar to the shutter-open actuator 202 in FIGS. 2A and 2B. That is, when the shutter 334 is pulled by the first actuator 334, the shutter 334 assumes an OPEN position. Similarly, the second actuator 332 shown in FIGS. 6A-6L can be a shutter-close actuator similar to the shutter-close actuator 204 shown in FIGS. 2A and 2B. That is, when the shutter 334 is pulled by the second actuator 334, the shutter 334 assumes a CLOSED position. In addition, the shutter 334 also may assume an intermediate (INT) position (or an equilibrium position as described by rule 1 discussed above in relation to FIGS. 2A and 2B). Based on the OPEN, CLOSED, or INT positions assumed by the shutter 334, the light modulator 302 can assume corresponding OPEN, CLOSED or INT states, respectively.

Figures 6A, 6B, 6C, 6D, 6E, 6F, 6G, 6H:
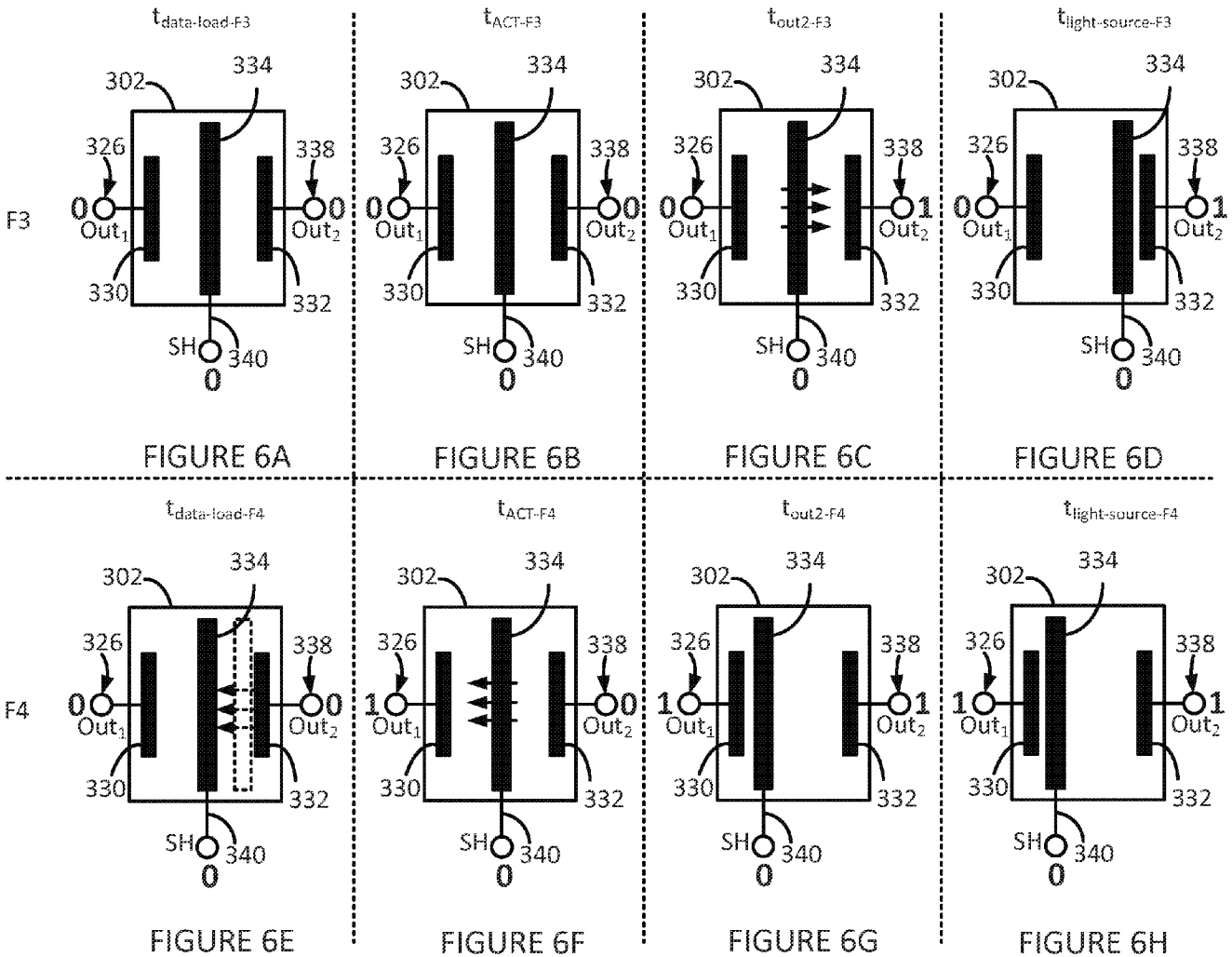
FIGS. 6A-6L show the state of the light modulator at various points in the example timing diagram shown in FIG. 5.

Referring to FIG. 5 and FIGS. 6A-6L, the image frame period F3 begins with the data loading period at time $t_{data\text{-}load\text{-}F3}$. As mentioned above, during the data loading period, the first output node 326 is discharged to about 0 V. As such, the voltage state of the first output node 326 at time $t_{data\text{-}load\text{-}F3}$ is '0'. The voltage state 504 of the second output node 332, which is driven by the global interconnect 336, is also '0'. As the voltage state of the shutter 344 is maintained at voltage state '0', the shutter 334 is not pulled to either the first actuator 330 or the second actuator 332. Instead the shutter 334 assumes an intermediate state (INT). The intermediate state of the shutter 334 is indicated in FIG. 6A (at time $t_{data\text{-}load\text{-}F3}$ for the image frame period F3).

At time $t_{ACT\text{-}F3}$, the data loading period ends and the actuation period begins. It is assumed that during image frame period F3, a data voltage of about 0 V is loaded into the pixel circuit 300. As a result, the voltage state 502 of the first output node 326 would be '0'. As the voltage states of both the first output node 330 and the second output node 332 are unchanged, the shutter 334 remains in the intermediate state, as shown in FIG. 6B.

At time $t_{out2\text{-}F3}$, the voltage state 504 of the second output node 338 is switched to voltage state '1'. This causes the shutter 334 to be pulled towards the second actuator 332. The transitioning of the shutter 334 into the CLOSED position is indicated in FIG. 6C at time $t_{out2\text{-}F3}$ by arrows pointing towards the second actuator 332. At time $t_{light\text{-}source\text{-}F3}$, the shutter 334 has assumed a CLOSED position and the light-source state 508 can be changed from the OFF state to the ON state. The CLOSED position of the shutter 334 at time $t_{light\text{-}source\text{-}F3}$ is indicated in FIG. 6D by positioning the shutter 334 closer to the second actuator 332 than to the first actuator 330.

Referring to FIG. 5, the next image frame period F4 begins with the data load period at time $t_{data\text{-}load\text{-}F4}$. At this time, the first output node 326 is discharged. As the previous voltage state 502 of the first output node 326 was '0', the discharging of the first output node 326 does not change the voltage state '0' of the first output node 326. At the same time, the voltage state 504 of the second output node 338 is switched to '0'. As a result, the shutter 334 moves to an intermediate position. FIG. 6E, for image frame period F4 and at time $t_{data\text{-}load\text{-}F4}$, shows the movement of the shutter from the previously CLOSED position to the intermediate position. In contrast with image frame period F3, during which a data voltage corresponding to a CLOSED position of the shutter 334 is loaded into the pixel circuit, it is assumed that for image frame period F4, a data voltage corresponding to an OPEN position of the shutter 334 is loaded into the pixel circuit 300.

At time $t_{ACT\text{-}F4}$, the voltage state 502 of the first output node 326 changes to voltage state '1'. The change of voltage state of the first output node 326 at time $t_{ACT\text{-}F4}$ can be similar to the increase in the voltage at the first output node 326 from about 0 V to about 25 V, as shown in FIG. 4 at time $t_3$. As the voltage state 504 of the second output node 338 is at voltage state '0', the shutter 334 would be pulled towards the first actuator 330. The movement of the shutter 334 towards the first actuator 330 is shown in FIG. 6F for image frame period F4 at time $t_{ACT\text{-}F4}$. Thus, the light modulator 302 begins to transition to an OPEN state.

At time $t_{out2\text{-}F4}$, the voltage state of the second output node 338 switches from voltage state '0' to voltage state '1', by which time the light modulator 302 has completed its transition to the OPEN position, as shown in FIG. 6G. As the shutter 334 is already in the OPEN position, the second output node's 338 change to the voltage state '1', does not affect the OPEN position of the shutter 334. Thus, the light modulator 302 remains in the OPEN state as shown in FIG. 6H. After a brief interval, which allows for other light modulators 302 to settle into their intended states, the light-source state 508 is switched from the OFF state to the ON state at time $t_{light\text{-}source\text{-}F4}$.

Figures 6I, 6J, 6K, 6L:
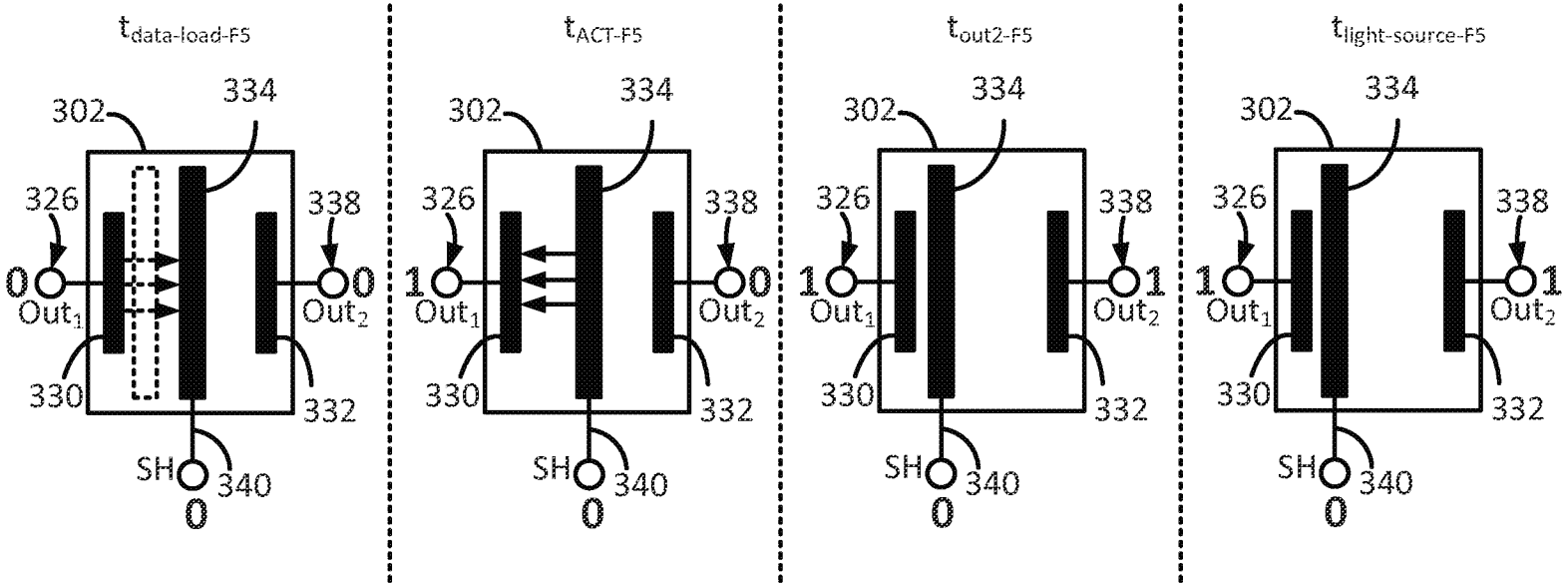

At the beginning of the image frame period F5, the voltage states of the first output node 326 and the second output node 338 are switched from voltage state '1' to voltage state '0' at time $t_{data\text{-}load\text{-}F5}$. Thus, as shown in FIG. 6I, the shutter 334 switches to an intermediate position from a previously held OPEN position. As with image frame period F4, the data voltage loaded into the pixel circuit 300 for image frame period F5 corresponds to an OPEN state of the light modulator 302. As a result, when the actuation period begins at time $t_{ACT\text{-}F5}$, the voltage state 502 of the first output node 326 switches from voltage state '0' to voltage state '1'. This results in the shutter 334 to be pulled towards the first actuator 330, which is shown in FIG. 6J. Thus the light modulator 302 begins to transition from an intermediate state to an OPEN state.

At time $t_{out2\text{-}F5}$, the voltage state 504 of the second output node 338 is also switched from voltage state '0' to voltage state '1' (as shown in FIG. 6K). By this time the light modulator 302 has settled into the OPEN state. Subsequently, at time $t_{light\text{-}source\text{-}F5}$ the state 508 of the light-source is switched from the OFF state to the ON state. The state of the light modulator 302 remains in the OPEN state, as shown in FIG. 6L.

In some implementations, the duration of time for which the state of the light-source is maintained in the ON state during an image frame period can be increased. For example, referring to FIG. 5, and in particular the transition from image frame period F4 to the image frame period F5, at the beginning of the data loading period (starting at time $t_{data\text{-}load}$), the voltage state 502 of the first output node 326 is switched from voltage state '1' to voltage state '0'. As the voltage state of the shutter 334 is maintained at voltage state '0', the switching of the voltage state 502 of the first output node 326 results in the light modulator 302 switching to an intermediate state 506. As the light modulator 302 is in an intermediate state, the state of the light-source would be switched to the OFF state.

Figure 7:
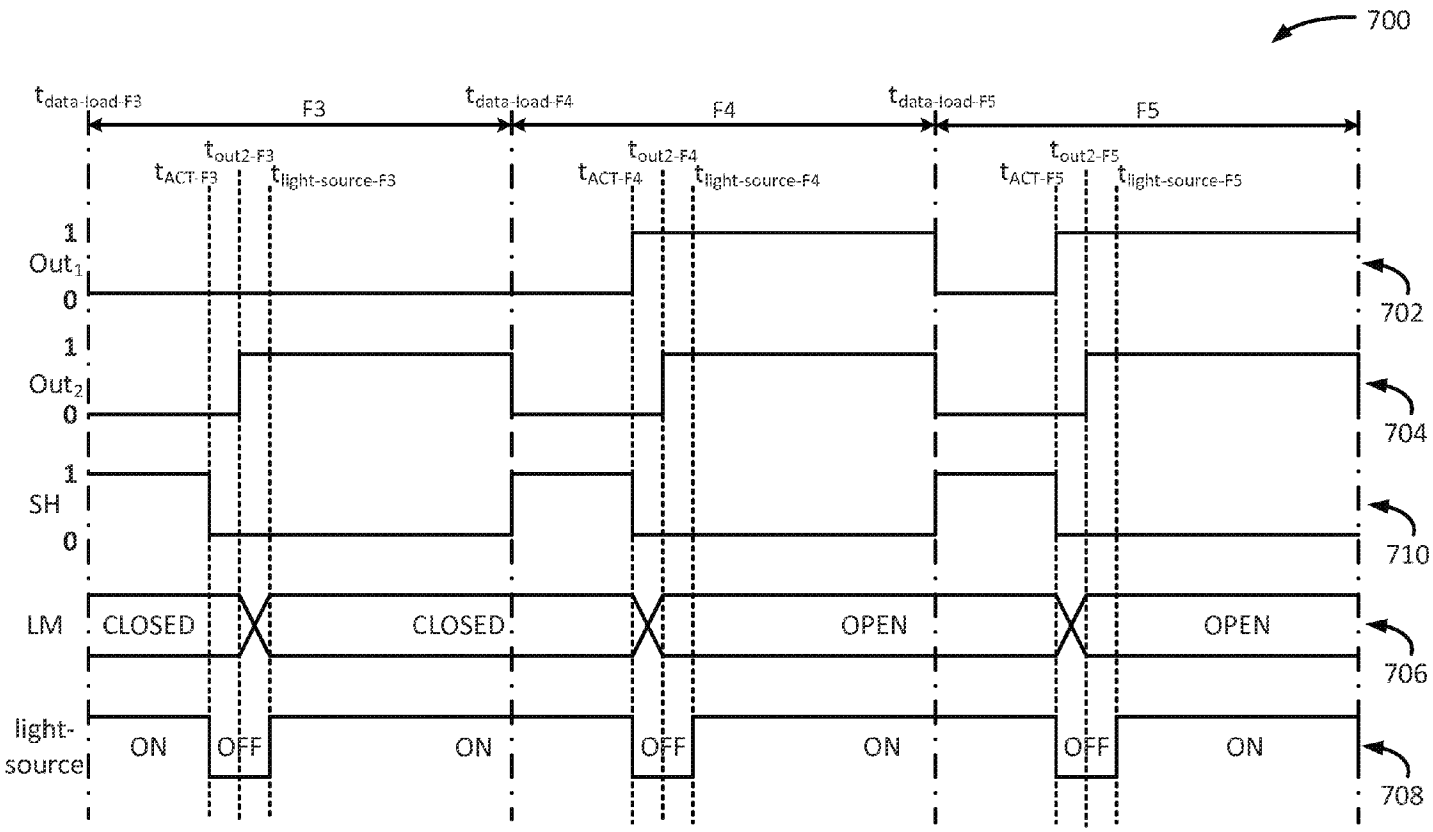
FIG. 7 shows another example timing diagram for the pixel circuit shown in FIG. 3.
Figures 8A, 8B, 8C, 8D, 8E, 8F, 8G, 8H:
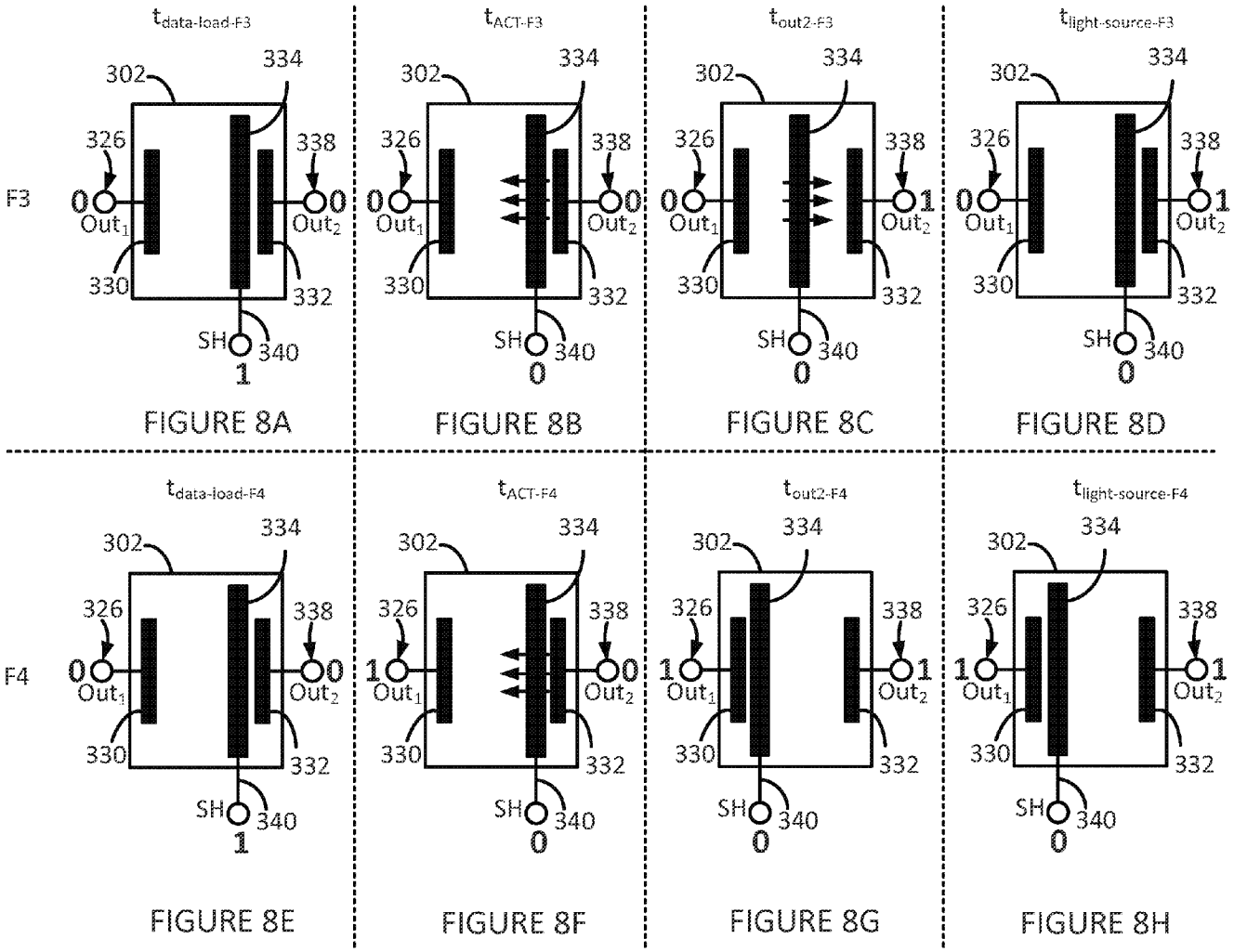
FIGS. 8A-8L show the states of the light modulator at various instances in the example timing diagram shown in FIG. 7.
Figures 8I, 8J, 8K, 8L:
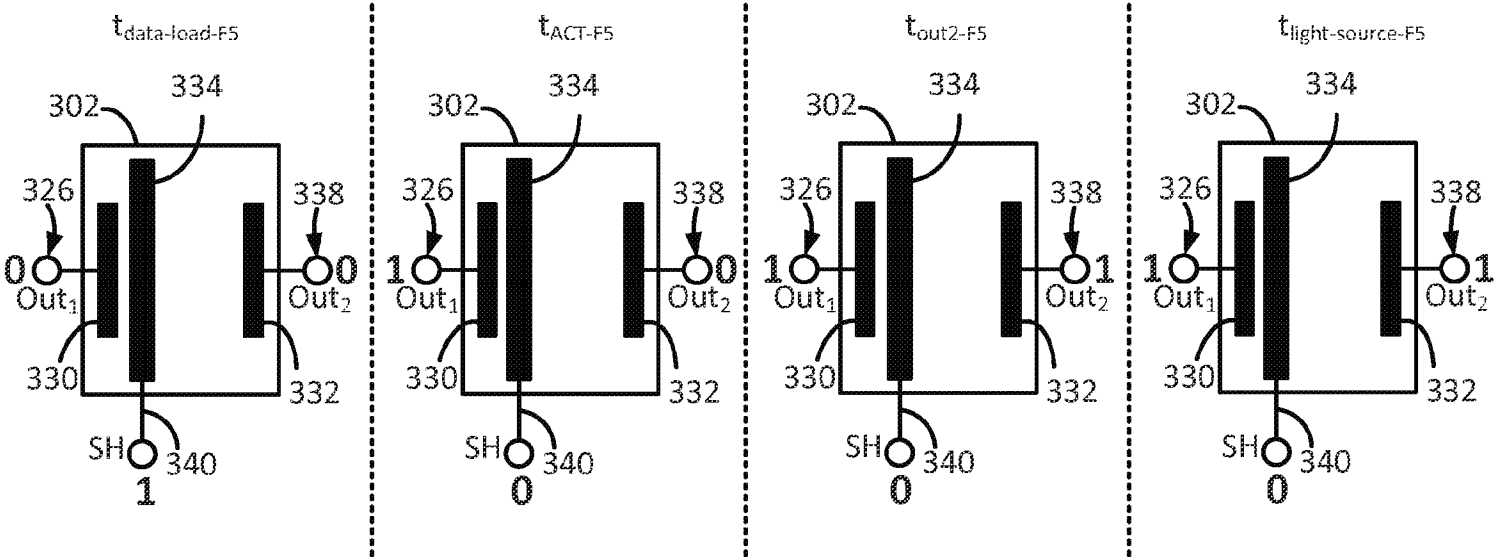

As indicated above, FIGS. 7-8L show various aspects of the operation of the pixel circuit 300. In particular, FIGS. 7-8L discuss the operation of the pixel circuit 300 and the light modulator 302 when the voltage on the shutter 334 is not constant, as it was in the operation discussed above in relation with FIGS. 5-6L. Specifically, the change in the voltage state of the shutter 334 is appropriately timed such that the shutter 334 assumes only the OPEN or CLOSED positions and not the INT position. The timing of the voltage state of the shutter 334, among others, is discussed below in relation to FIG. 7. Furthermore, similar to the FIGS. 6A-6L, FIGS. 8A-8L show the states of the light modulator 302 at various instances in the timing diagram shown in FIG. 7.

FIG. 7 shows another example timing diagram 700 for the pixel circuit 300 shown in FIG. 3. In particular, the timing diagram 700 represents an operation of the pixel circuit 300 that increases the duration for which the light-source state can be maintained in the ON state. This can be accomplished by manipulating the voltage state of the shutter 334 while data is being loaded into the pixel circuit 300 for a subsequent image frame period. Specifically, the voltage state of the shutter 334 can be switched at the beginning of the data loading period such that the state of the light modulator 302, instead of switching to an intermediate state, is maintained in its state from the previous image frame period until the light modulator 302 can assume its state for the current image frame period.

FIG. 7 shows the voltage state 702 of the first output node $Out_1$ 326, the voltage state 704 of the second output node $Out_2$ 338, the state 706 of the light modulator 302, the state 708 of a light-source used for illuminating the array of light modulators such as the light modulator 302, and the voltage state 710 of the shutter 334. FIG. 7 shows the timing diagram 700 during the same image frame periods F3, F4, and F5 shown in FIG. 5. As the data voltage loaded into the pixel circuit 300 during the image frame periods F3, F4, and F5 is the same as the data voltage loaded in the corresponding image frame periods shown in FIG. 5, the voltage state 702 of the first output node 326 can be similar to the voltage state 502 for the first output node 326 shown in FIG. 5. Furthermore, the globally controlled voltage state 704 of the second output node 338 shown in FIG. 7 can be similar to the globally controlled voltage state 504 of the second output node 338 shown in FIG. 5.

As mentioned above, FIGS. 8A-8L show the states of the light modulator 302 at various instances in the example timing diagram 700 shown in FIG. 7. Specifically, FIGS. 8A-8D show the states of the light modulator 302 at times $t_{data\text{-}load\text{-}F3}$, $t_{ACT\text{-}F3}$, $t_{out2\text{-}F3}$, and $t_{light\text{-}source\text{-}F3}$ for image frame period F3; FIGS. 8E-8H show the states of the light modulator 302 at times $t_{data\text{-}load\text{-}F4}$, $t_{ACT\text{-}F4}$, $t_{out2\text{-}F4}$, and $t_{light\text{-}source\text{-}F4}$ for image frame period F4; and FIGS. 8I-8L show the states of the light modulator 302 at times $t_{data\text{-}load\text{-}F5}$, $t_{ACT\text{-}F5}$, $t_{out2\text{-}F5}$, and $t_{light\text{-}source\text{-}F5}$ for image frame period F5.

Referring to FIG. 7 and FIGS. 8A-8L, and specifically to time $t_{data\text{-}load\text{-}F5}$ at the transition from image frame period F4 to image frame period F5, the voltage state 702 of the first output node 326 is switched from voltage state '1' to voltage state '0'. Similarly, the voltage state 704 of the second output node 338 is switched from voltage state '1' to voltage state '0'. The state 706 of the light modulator 302 before $t_{data\text{-}load\text{-}F5}$ is OPEN. That is, the shutter 334 (in voltage state '0') is being pulled by the first actuator 330 (in voltage state '1') towards an OPEN position, as shown in FIG. 8H. If the voltage state 710 of the shutter 334 were to be maintained at voltage state '0' after $t_{data\text{-}load\text{-}F5}$ (as was the case in the timing diagram 500 shown in FIG. 5), the shutter 334 would not experience an electrostatic force towards either the first actuator 330 or towards the second actuator 332 as both of actuators 330 and 332 would also be at voltage state '0'). As a result, the shutter 334 would switch to an intermediate position, and, consequently, the state 706 of the light modulator 302 would switch to the intermediate state (as shown in FIG. 6I). However, as the voltage state 710 of the shutter 334 is also switched from voltage state '0' to voltage state '1' at time $t_{data\text{-}load\text{-}F5}$, the voltage states of the shutter 334 and the first actuator 330 remain at opposite voltage states '1' and '0', respectively. Therefore, the electrostatic force between the shutter 334 and the first actuator 330 is maintained, causing the shutter 334 to continue to be pulled by the first actuator 330 into an OPEN position, as shown in FIG. 8I. As a result, the state of the light modulator 302 does not change from its previous OPEN state. Therefore, the state 708 of the light-source can be maintained in the ON state during the data loading period of the image frame period F5.

At time $t_{ACT\text{-}F5}$, when the data loading period ends and the actuation period begins, the voltage state 710 of the shutter 334 is switched back to voltage state '0'. The state 708 of the light-source is also switched from the ON state to the OFF state. At time $t_{ACT\text{-}F5}$, each light modulator in the display array can assume a state based on the data voltage loaded during the data loading period for image frame period F5. That is, the light modulators 302 may transition from one state to another. Thus, the state 708 of the light-source can be switched OFF to allow the light modulators 302 to successfully transition to their next state. The state 706 of the light modulator 302 shown in FIG. 7 remains in the OPEN state. This is due to the voltage state 702 of the first output node 326 switching to voltage state '1' continuing to pull the shutter 334, as shown in FIG. 8J.

The switching of the voltage state 710 of the shutter 334 as described above between image frame periods F4 and F5 can be similarly carried out during the transitions between any two image frame periods. For example, in transitioning from the image frame period F3 to image frame period F4, the voltage state 710 of the shutter 334 is switched form voltage state '0' to voltage state '1' at the beginning of the data loading period of the image frame period F4 (as shown in FIG. 8E) and switched back from voltage state '1' to voltage state '0' at the end of the data loading period (as shown in FIG. 8F). Thus, at time $t_{data\text{-}load\text{-}F4}$, when the voltage state 704 of the second actuator 332 switches from voltage state '1' to voltage state '0', the voltage state 710 of the shutter 334 is also switched from the voltage state '0' to voltage state '1'. Thus, the shutter continues to experience an electrostatic force pulling the shutter towards the second actuator 332 into a CLOSED position. As a result, the state 706 of the light modulator 302 is maintained in its previous CLOSED state while the data voltage for the current frame period F4 is being loaded into the pixel circuit 300.

Similarly, when transitioning to the image frame period F3 from the image frame previous to the image frame period F3, the voltage state 710 of the shutter 334 is switched from the voltage state '0' to the voltage state '1' at the beginning (time $t_{data\text{-}load\text{-}F3}$) of the data loading period of the image frame period F3 (as shown in FIG. 8A). Thus, even though the voltage state 704 of the second actuator 332 is switched to the voltage state '0', the voltage states of the shutter 334 and the second actuator 332 are maintained in opposing voltage states. As a result, the shutter 334 continues to experience an electrostatic force pulling the shutter 334 towards the second actuator 332 and into a CLOSED position. Thus, the state 706 of the light modulator 302 is maintained in the CLOSED state while the data voltage for the image frame period F3 is being loaded into the pixel circuit 300. The voltage state of the shutter 334 is then switched back to voltage state '0' at the end of the data loading period (as shown in FIG. 8B).

The state of the light modulator 302 shown in FIGS. 8C, 8D, 8G, 8H, 8K, and 8L is similar to that shown in FIGS. 6C, 6D, 6G, 6H, 6K, and 6L, respectively.

In some implementations, the increase in the period for which the state 708 of the light-source can be maintained in an ON state allows the display device to display the image with greater pixel intensity. In some other implementations, with the increased illumination time, the illumination intensity of the light-source, and therefore the power consumption of the display, can be reduced.

Figure 9:
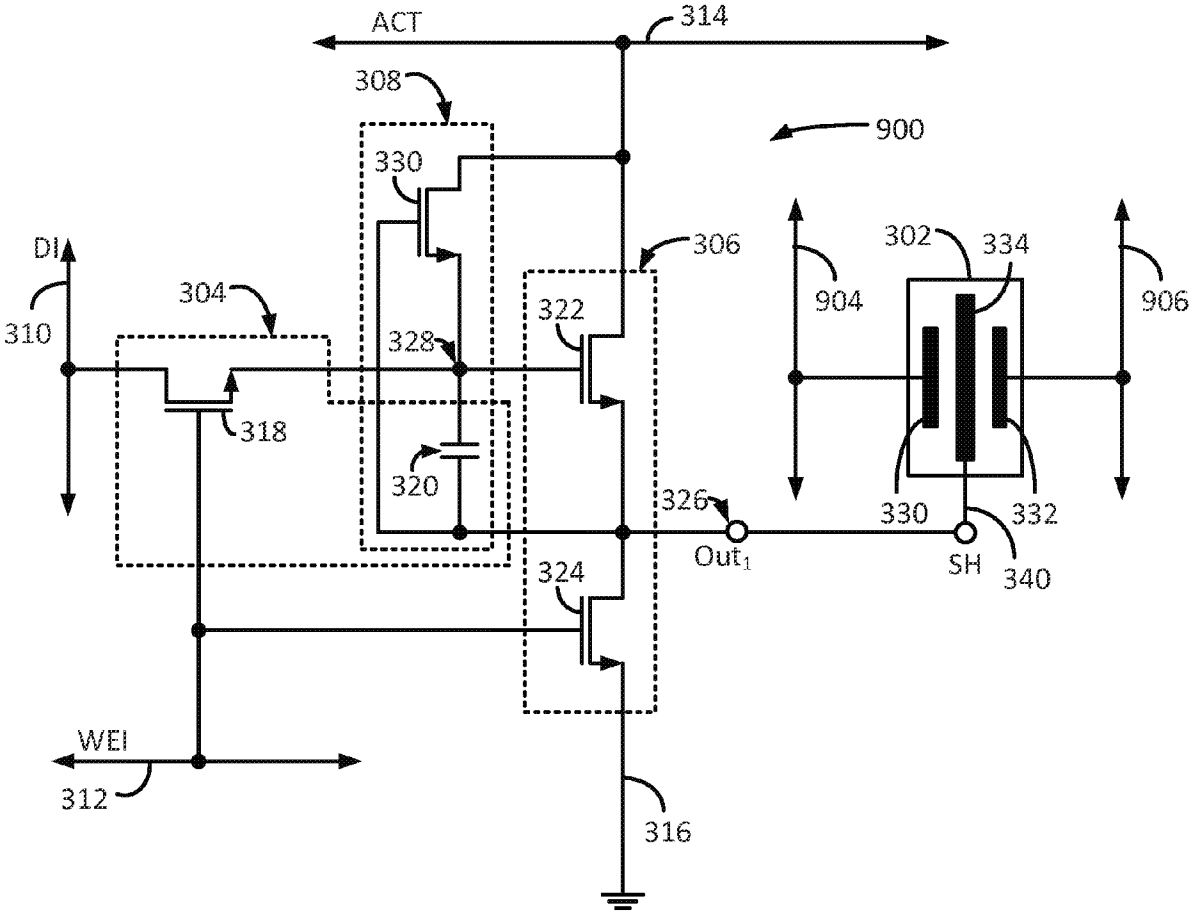
FIG. 9 shows a second example pixel circuit that can be implemented for controlling the light modulator.
Figure 12:
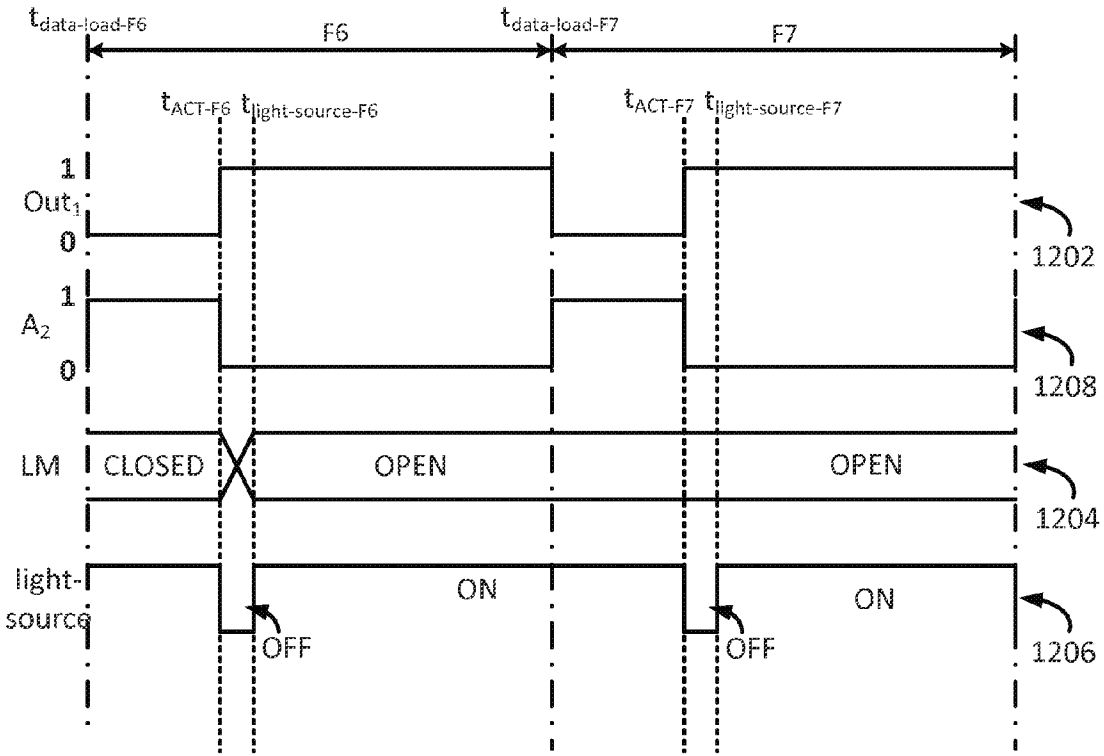
FIG. 12 shows another example timing diagram for the pixel circuit shown in FIG. 9.
Figures 13A, 13B, 13C, 13D, 13E, 13F:
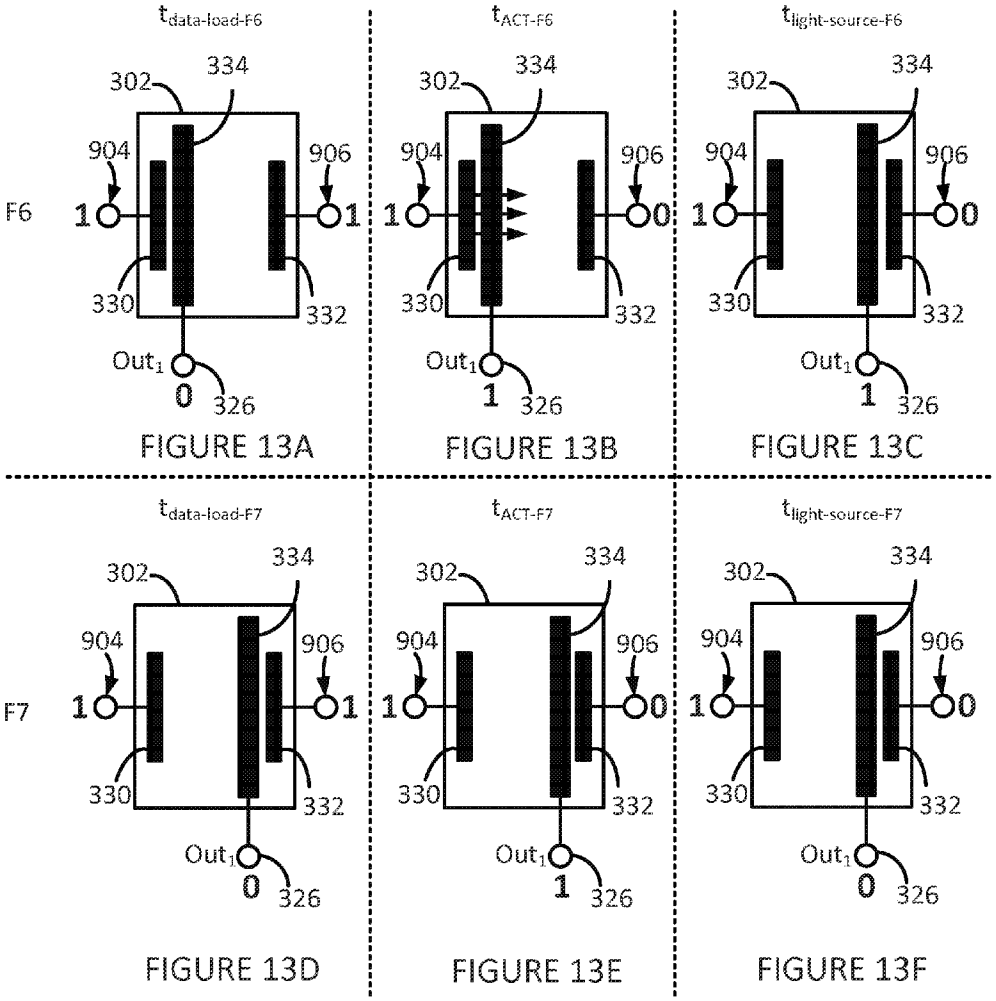
FIGS. 13A-13F show the states of the light modulator at various instances in the example timing diagram shown in FIG. 12.

As discussed above in relation to FIGS. 4-8K, the pixel circuit 300 and the light modulator 302 are interconnected such that the first output node 326 of the pixel circuit 300 drives the first actuator 330 of the light modulator. However, in some implementations, the light modulator 302 also can be operated by the first output node 326 of the pixel circuit driving the shutter 334 of the light modulator 302. FIGS. 9-13F describe one example of such a configuration. In particular, FIG. 9 shows a pixel circuit 900, in which the first output node 326 of the pixel circuit 900 drives the shutter 334 of the light modulator 302. The discussion of FIGS. 10-11F focuses on the operation of the pixel circuit 900 and the light modulator when the first actuator 330 and the second actuator 332 are operated in complementary voltage states. FIGS. 12-13F, on the other hand, discuss operating the pixel circuit 900 and the light modulator 302 where the first actuator 330 and the second actuator 332 are momentarily operated in non-complementary voltage states to advantageously provide an increase in a time period for which the light-source can be illuminated.

As mentioned above, FIG. 9 shows a second example pixel circuit 900 that can be implemented for controlling a light modulator 302. In particular, the pixel circuit 900 can be used to control dual actuator light modulators, such as the light modulator 200 shown in FIGS. 2A and 2B. The pixel circuit 900 can be part of a control matrix that controls an array of pixels that incorporate light modulators similar to the light modulator 302.

The second example pixel circuit 900 is similar to the first example pixel circuit 300 shown in FIG. 3. As such, elements in the second pixel circuit 900 similar to the corresponding elements in the first pixel circuit 300 shown in FIG. 3 are referred to with the same reference numerals. However, in contrast to the first example pixel circuit 300 shown in FIG. 3, in which the first output node 326 is coupled to the first actuator 330 of the light modulator 302, the first output node 326 of the second example pixel circuit 900 is instead coupled to the shutter 334 of the light modulator 302 via the shutter terminal 340. Furthermore, the first actuator 330 and the second actuator 332 of the light modulator 302 can be coupled to a first actuator interconnect 904 and a second actuator interconnect 906, respectively. In some implementations, the first actuator interconnect 904 and the second actuator interconnect 906 can be global interconnects. As such, the first actuator interconnect 904 may be coupled to the first actuators of all light modulators in the pixel array, and the second actuator interconnect 906 may be coupled to the second actuators of all light modulators in the pixel array.

Figure 10:
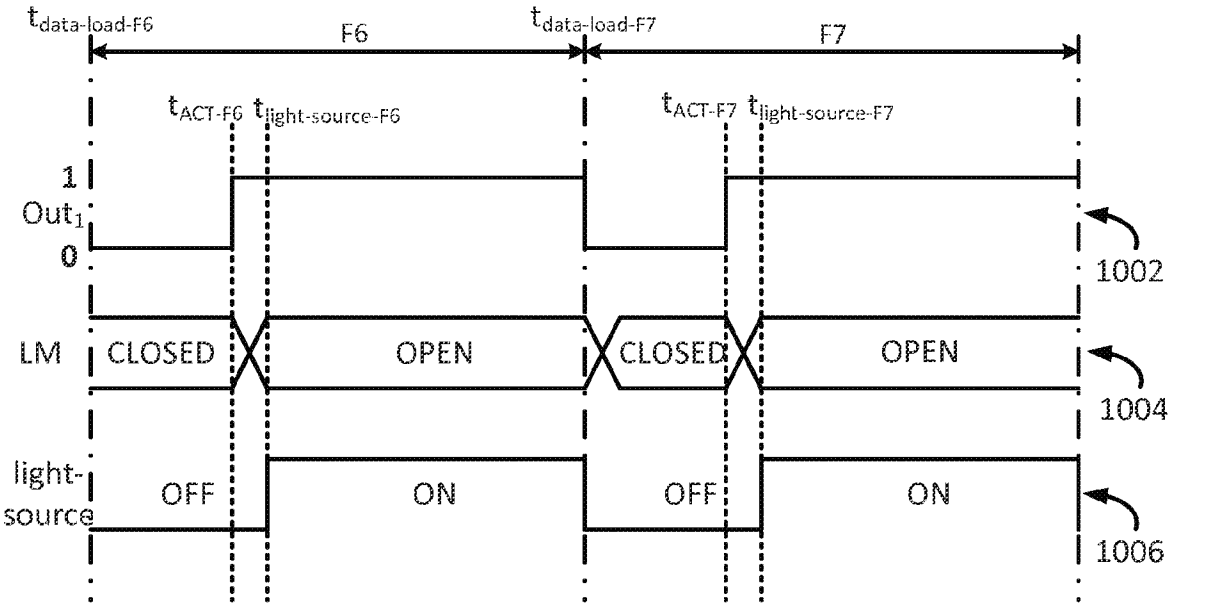
FIG. 10 shows an example timing diagram for the pixel circuit shown in FIG. 9.

FIG. 10 shows an example timing diagram 1000 for the pixel circuit 900 shown in FIG. 9. In particular, FIG. 10 shows the voltage state 1002 of the first output node $Out_1$ 326, the state 1004 of the light modulator 302, and the state 1006 of a light-source used for illuminating an array of light modulators such as the light modulator 302. Similar to the convention used in FIG. 5, voltage states '0' and '1 associated with the first output node 326 represent non-actuated and actuated states. For example, referring to the example timing diagram shown in FIG. 4, the voltage state '0' can represent a voltage of about 0 V, and the voltage state '1' can represent a voltage of about 25 V (the actuation voltage). Thus, when the voltage state of the first output node 326 is '0', this means that the first output node 326 is at a voltage of about 0 V, and when the voltage state is '1' then the first output node 326 is at a voltage of about 25 V.

The light modulator (LM) can switch between OPEN and CLOSED states. While not shown in FIG. 10, the first actuator interconnect 904 and the second actuator interconnect 906 are maintained at complementary voltage states. For example, if the first actuator interconnect 904 is maintained at the actuation voltage of about 25 V, then the second actuator interconnect 906 would be maintained at a voltage of about 0 V. In some other implementations, the second actuator interconnect 906 can be maintained at about 25 V, while the first actuator interconnect 904 may be maintained at about 0 V. In some implementations, the voltages at the first actuator interconnect 904 and the second actuator interconnect 906 can be alternated from one image frame to the next.

The light modulator 302 state 1004 can be based on the voltage states of the first shutter 334, the first actuator 330 and the second actuator 332. For FIG. 10, it is assumed that the first actuator 330 is a CLOSED state actuator while the second actuator 332 is an OPEN state actuator. This means that when the shutter 334 is pulled towards the first actuator 330, the light modulator is in a CLOSED state, and when the shutter is pulled towards the second actuator 332, the light modulator is switched to an OPEN state. However, it is understood that in some implementations, the first actuator 330 could be an OPEN state actuator while the second actuator 332 could be a CLOSED state actuator.

The light-source state 1006 shows that the light-source can switch between an ON and an OFF state. In the ON state the light-source emits light, while in the OFF state the light-source does not emit light.

The timing diagram 1000 includes image frame periods F6 and F7. In some implementations, the image frame periods F6 and F7 can represent subframe periods of an image frame. The image frame periods F6 and F7 can be similar to the image frame periods F1 and F2 shown in FIG. 4, in that like the image frame periods F1 and F2, the image frame periods F6 and F7 also include data loading periods and actuation periods. For example, in each of the image frame periods F6 and F7, the data loading periods begin at time $t_{data\text{-}load\text{-}F6}$ and $t_{data\text{-}load\text{-}F7}$, respectively, and end at time $t_{ACT\text{-}F6}$ and $t_{ACT\text{-}F7}$, respectively; and the actuation period begins at $t_{ACT\text{-}F6}$ and $t_{ACT-F7}$, respectively, and ends at the beginning of the data loading period for the following image frame period. Time instants $t_{ACT-F6}$ and $t_{ACT-F7}$ shown in FIG. 10 can be similar to the time instants $t_3$ and $t_7$, shown in FIG. 4, at which times the actuation periods for image frame periods F1 and F2, respectively, begin. Time instants $t_{data-load-F6}$ and $t_{data-load-F7}$ can be similar to the beginning of the frame period F1 and time instant $t_5$, shown in FIG. 4.

The actuation period within each image frame period F6 and F7 also includes times $t_{light-source-F6}$ and $t_{light-source-F7}$, respectively. The times $t_{light-source-F6}$ and $t_{light-source-F7}$ indicate the times when the state of the light-source can be switched from the OFF state to the ON state in the image frame periods F6 and F7, respectively. A time delay is inserted between $t_{ACT-F6}/t_{ACT-F7}$ and $t_{light-source-F6}/t_{light-source-F7}$ to allow the light modulator 302 sufficient time to settle into a state.

Figures 11A, 11B, 11C, 11D, 11E, 11F:
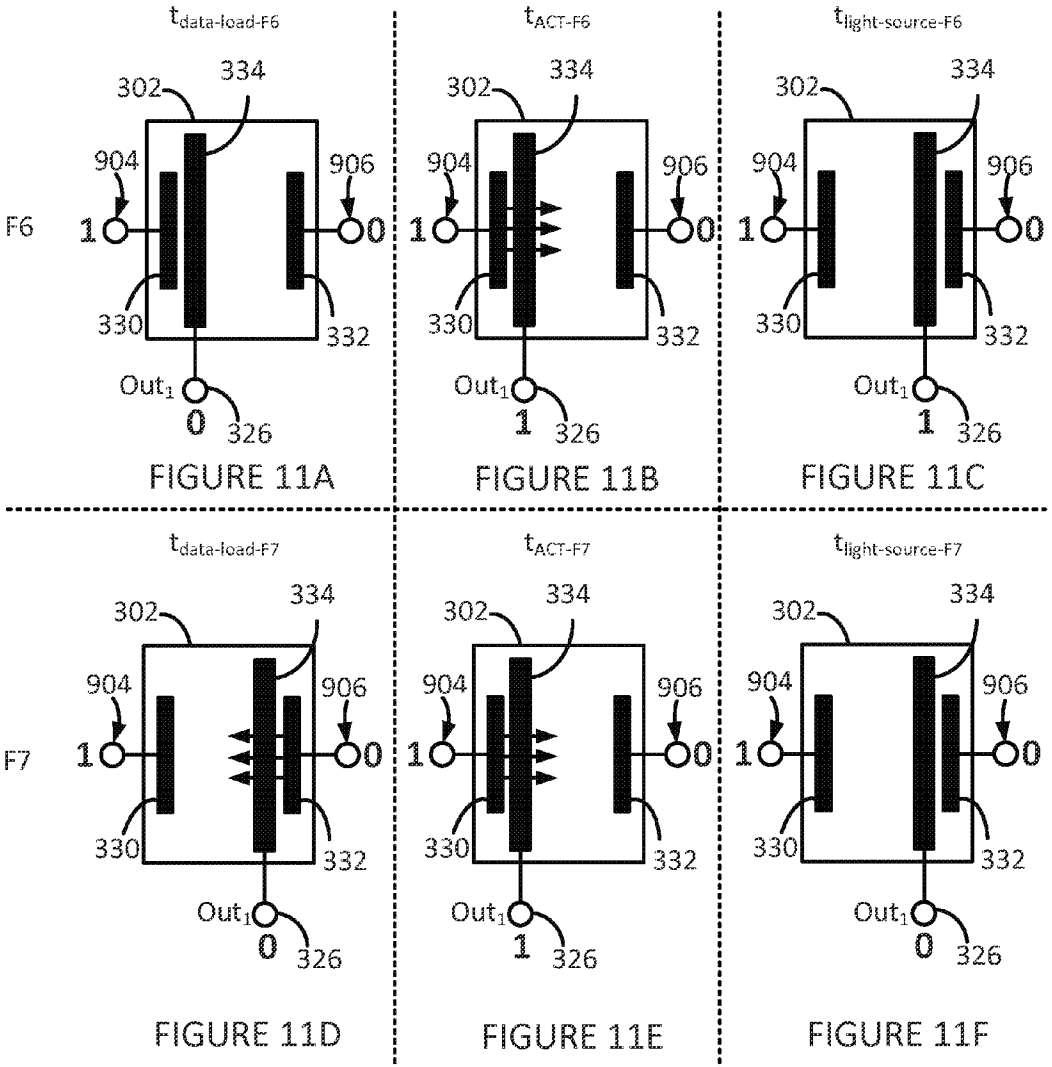
FIGS. 11A-11F show the state of the light modulator at various points in the example timing diagram shown in FIG. 10.

FIGS. 11A-11F show the state of the light modulator 302 at various points in the example timing diagram shown in FIG. 10. In particular, FIGS. 11A-11C show the position of the shutter 344 at times $t_{data-load-F6}$, $t_{ACT-F6}$, and $t_{light-source-F6}$ during the image frame period F6, and FIGS. 11D-11F show the position of the shutter 344 at times $t_{data-load-F7}$, $t_{ACT-F7}$, and $t_{light-source-F7}$ during the image frame period F7. As mentioned above, the first actuation interconnect 904 and the second actuation interconnect 906 are maintained at complementary voltage states throughout the operation of the light modulator 302. This is denoted by the first actuator 330 and the second actuator 332 being maintained at voltage states '1' and '0', respectively. Furthermore, the first output node 326 is coupled to the shutter 334.

Referring to FIG. 10, the image frame period F6 begins with the data loading period at time $t_{data-load-F6}$. As mentioned above, during the data loading period, the first output node 326 is discharged to about 0 V. As such, the voltage state of the first output node 326 at time $t_{data-load-F6}$ is '0'. As the first actuator 330 is maintained at voltage state '1' and the second actuator 332 is maintained at voltage state '0', the shutter 334 is pulled towards the first actuator 330. As the first actuator 330 is a CLOSED state actuator, the light modulator 302 switches into a CLOSED state, as shown in FIG. 11A. During the data loading period, the shutters 334 of all the light modulators belonging to at least the same row are at voltage state '0'. As no image can be displayed during this period, the state 1006 of the light-source is switched to the OFF state.

At time $t_{ACT-F6}$, the data loading period ends and the actuation period begins. It is assumed that during image frame period F6, a data voltage of about 5 V is loaded into the pixel circuit 900. As a result, the voltage state 502 of the first output node 326 would be '1'. Thus, the shutter 334 would be pulled towards the second actuator 332, which is maintained at voltage state '0', as shown in FIG. 11B.

A time delay is inserted between $t_{ACT-F6}$ and $t_{light-source-F6}$ to allow the light modulator 302 of all the pixels in the pixel array to settle into their respective intended states. By time $t_{light-source-F6}$, the shutter 334 moves to the OPEN position near the second actuator 332 (as shown in FIG. 11C), resulting in the state 1004 of light modulator to move into the OPEN state.

The next image frame period F7 begins with the data loading period at time $t_{data-load-F7}$. At this time the first output node 326 is discharged. As the previous voltage state 1002 of the first output node 326 was voltage state '1', the discharging of the first output node 326 causes the voltage state of the shutter 334 to change from voltage state '1' to voltage state '0'. While in the previous voltage state '1', the shutter 334 is pulled by the second actuator 332, which is at voltage state '0', when the voltage state of the shutter 334 is changed to voltage state '0', the shutter 334 is pulled towards the first actuator 330, which is maintained at voltage state '1' (as shown in FIG. 11D). Additionally, the state 1006 of the light-source is switched to the OFF state.

The actuation period begins at time $t_{ACT-F7}$. As the data voltage loaded into the pixel circuit 900 is about 5 V, the output voltage at the first output node 326 increases to the actuation voltage. Thus, the voltage state 1002 of the first output node 326 changes from voltage state '0' to voltage state '1'. As the voltage state 1002 of the first output node 326 switches to voltage state '1', the voltage state of the shutter 334 also switches to voltage state '1'. As the second actuator 332 is maintained at the voltage state '0', the shutter 334 would be pulled towards the second actuator 332 and into an OPEN position (as shown in FIG. 11E). Thus, the state 1004 of the light modulator 302 begins to transition from the CLOSED state to the OPEN state.

At time $t_{light-source-F7}$, the state 1006 of the light-source is switched form the OFF state to the ON state. At this time, the light modulators 302 of all the pixels in the pixel array would have settled into their respective states. Thus, when the light-source is illuminated in the ON state, an image can be displayed by the display device.

As mentioned above, in some implementations, the duration of time for which the state of the light-source is maintained in the ON state during an image frame period can be increased. For example, referring to FIG. 10, and in particular the transition from the image frame period F6 to the image frame period F7, at the beginning of the data loading period (starting at time $t_{data-load-F7}$), the voltage state 1002 of the first output node 326 is switched to voltage state '0', irrespective of its previous voltage state. As a result, the state 1004 of the light modulator 302 switches to the CLOSED state if it was not in the CLOSED state already. In fact, as the write enable interconnect 312 is coupled to all pixel circuits in the same row of the pixel array, the states of all the light modulators in the same row as the light modulator 302 in the pixel array would switch to the CLOSED state if not in the CLOSED state already. Thus, no image can be displayed during the data loading period.

FIG. 12 shows another example timing diagram 1200 for the pixel circuit 900 shown in FIG. 9. In particular, the timing diagram 1200 represents an operation of the pixel circuit 900 that increases the duration for which the light-source state can be maintained in the ON state. FIGS. 13A-13F show the states of the light modulator 302 at various instances in the timing diagram 1200.

In some implementations, an increase in the duration for which the light-source state can be maintained in the ON state can be accomplished by manipulating the voltage states of the first actuator interconnect 904 and the second actuator interconnect 906. Specifically, the voltage state of, for example, the second actuator interconnect 906 can be switched at the beginning of the data loading period such that the state of the light modulator 302 is maintained in its previous state. As the state of the light modulator 302 does not switch during the data loading period, the state of the light-source can be maintained in the ON state.

FIG. 12 shows the voltage state 1202 of the first output node 326, the state 1204 of the light modulator 302, the state 1206 of the light-source, and the voltage state 1208 of the second actuator interconnect 906 (denoted by $A_2$). FIG. 12 shows the timing diagram during the same image frame periods F6 and F7 shown in FIG. 10. As the data voltage loaded in the pixel circuit 900 for image frame periods F6 and F7 shown in FIG. 12 is the same as that loaded for the corresponding image frame periods shown in FIG. 10, the voltage state 1202 of the first output node 326 can be similar to the voltage state 1002 of the first output node 326 shown in FIG. 10.

As mentioned above, FIGS. 13A-13F show the states of the light modulator 302 at various instances in the example timing diagram 1200 shown in FIG. 12. Specifically, FIGS. 13A-13C show the position of the shutter 334 at times $t_{data\text{-}load\text{-}F6}$, $t_{ACT\text{-}F6}$, and $t_{light\text{-}source\text{-}F6}$ during the image frame period F6, and FIGS. 13D-13F show the position of the shutter 334 at times $t_{data\text{-}load\text{-}F7}$, $t_{ACT\text{-}F7}$, and $t_{light\text{-}source\text{-}F7}$ during the image frame period F7.

Referring to FIG. 12, and specifically at time $t_{data\text{-}load\text{-}F7}$ at the transition from the image frame period F6 to the image frame period F7, the voltage state 1208 of the second actuator interconnect 906 is switched from voltage state '0' to voltage state '1'. Note that this is in contrast with the voltage state of the second actuator 906 discussed above in relation to FIG. 10, in which the voltage state of the second actuator interconnect remains at voltage state '0', i.e., complementary to the voltage state '1' of the first actuator interconnect 904.

As shown in FIG. 12, at time $t_{data\text{-}load\text{-}F7}$, the commencement of the data loading period for image frame period F7 causes the voltage state 1202 of the first output node 326 to switch from voltage state '1' to voltage state '0'. If the voltage state 1208 of the second actuator interconnect 906 were to remain in voltage state '0' as in FIG. 10, then the state 1204 of the light modulator 302 would switch to the CLOSED state. This is because switching of the voltage state of the first output node 326 from voltage state '1' to voltage state '0' causes the voltage state of the shutter 334 to also switch from voltage state '1' to voltage state '0', and at voltage state '0' the shutter 334 would be pulled towards the first actuator 330, which is in voltage state '1', to a CLOSED position. However, as the voltage state 1208 of the second actuator interconnect 906 also switches to voltage state '1', the shutter 334 continues to be pulled by the second actuator 332 (as shown in FIG. 13D). Therefore, the state 1204 of the light modulator 302 continues in its previous OPEN state while the data voltage is being loaded into the pixel circuit 900. This allows for the state 1206 of the light-source to also remain in the ON state.

At time $t_{ACT\text{-}F7}$, when the actuation period begins, the voltage state 1208 of the second actuator interconnect 906 is reverted back to the voltage state '0', which is complementary to the voltage state '1' of the first actuator interconnect 904 (as shown in FIG. 13E). In the example shown in FIG. 12, a data voltage of about 5 V is loaded into the pixel circuit 900 during the image frame period F7. Therefore, at the beginning of the actuation period, the voltage state 1202 of the first output node 326 would be in voltage state '1'. As the voltage state 1208 of the second actuator interconnect 906 has switched to voltage state '0', the shutter 334 would continue to be pulled by the second actuator 332 into an OPEN position. Thus, the state 1204 of the light modulator 302 would continue to remain in the OPEN state.

The state 1206 of the light-source is switched to the OFF state for some duration of time at the beginning of the actuation period to allow for light modulators in other pixels to settle into their respective states.

In comparison with the timing diagram 1000 shown in FIG. 10, the timing diagram 1200 in FIG. 12 shows that the duration of time for which the state 1206 of the light-source can be maintained in the ON state has increased. Specifically, the state 1206 of the light-source can be maintained in the ON state throughout the data loading period in addition to the light-source illumination period.

The states of the light modulator 302 shown in FIGS. 13A-13C, and 13F are similar to that shown in FIGS. 11A-11C, and 11F, respectively.

As discussed above, in some implementations, the increase in the duration of time for which the state 1206 of the light-source can be maintained in an ON state allows the display device to display the image with greater pixel intensity. In some other implementations, for a given pixel intensity, the illumination intensity of the light-source, and therefore the power consumption, can be reduced.

While not shown in FIG. 12, if the state of the light modulator 302 were in the CLOSED state in one image frame period, the light modulator 302 would remain in the CLOSED state during the data loading period of the following image frame period. For example, during an image frame period if the voltage state of the first output node 326 is voltage state '0', while the voltage states of the first actuator 330 and the second actuator 332 are voltage states '1' and '0', then the shutter 334 would be pulled by the first actuator 330 into a CLOSED position. Thus, the light modulator 302 would be in the CLOSED state. When the following image frame period begins (such as the beginning of the image frame period F6 at time $t_{data\text{-}load\text{-}F6}$), the voltage state of the shutter 334 remains at its previous voltage state '0'. At that time, the voltage state of the second actuator 332 is switched from the voltage state '0' to the voltage state '1'. As the voltage state of the first actuator 330 is still at voltage state '1', the shutter 334 is continued to be pulled by the electrostatic force of the first actuator 330 and remains in the CLOSED position. Even though the voltage state of the second actuator 332 switches to voltage state '1', the electrostatic force of the second actuator 332 does not overcome the electrostatic force of the first actuator 330 on the shutter 334 (as per Rule 2 discussed above in relation to FIGS. 2A and 2B). The CLOSED state of the light modulator 302 is maintained until the end of the data loading period and the beginning of the actuation period (such as at time $t_{ACT\text{-}F6}$ in image frame period F6) for the following image frame, at which time the voltage state of the second actuator is brought back to voltage state '0' and the state of the light modulator 302 may switch to an OPEN state or remain in the CLOSED state based on the data voltage loaded during that image frame period.

In some implementations, the pixel circuit 300 shown in FIG. 3 and the pixel circuit 900 shown in FIG. 9 can be operated in an analog mode. In analog mode operation, the duration for which a shutter remains in the OPEN state or the CLOSED state can be controlled based on a magnitude of a data voltage stored in the pixel. This is in contrast with the digital operation discussed above in which the state, and not the duration thereof, of the shutter was determined by the magnitude of the data voltage stored in the pixel. The following discussion, with reference to FIG. 14, discusses the analog mode of operation of the pixel circuit 900 shown in FIG. 9.

Figure 14:
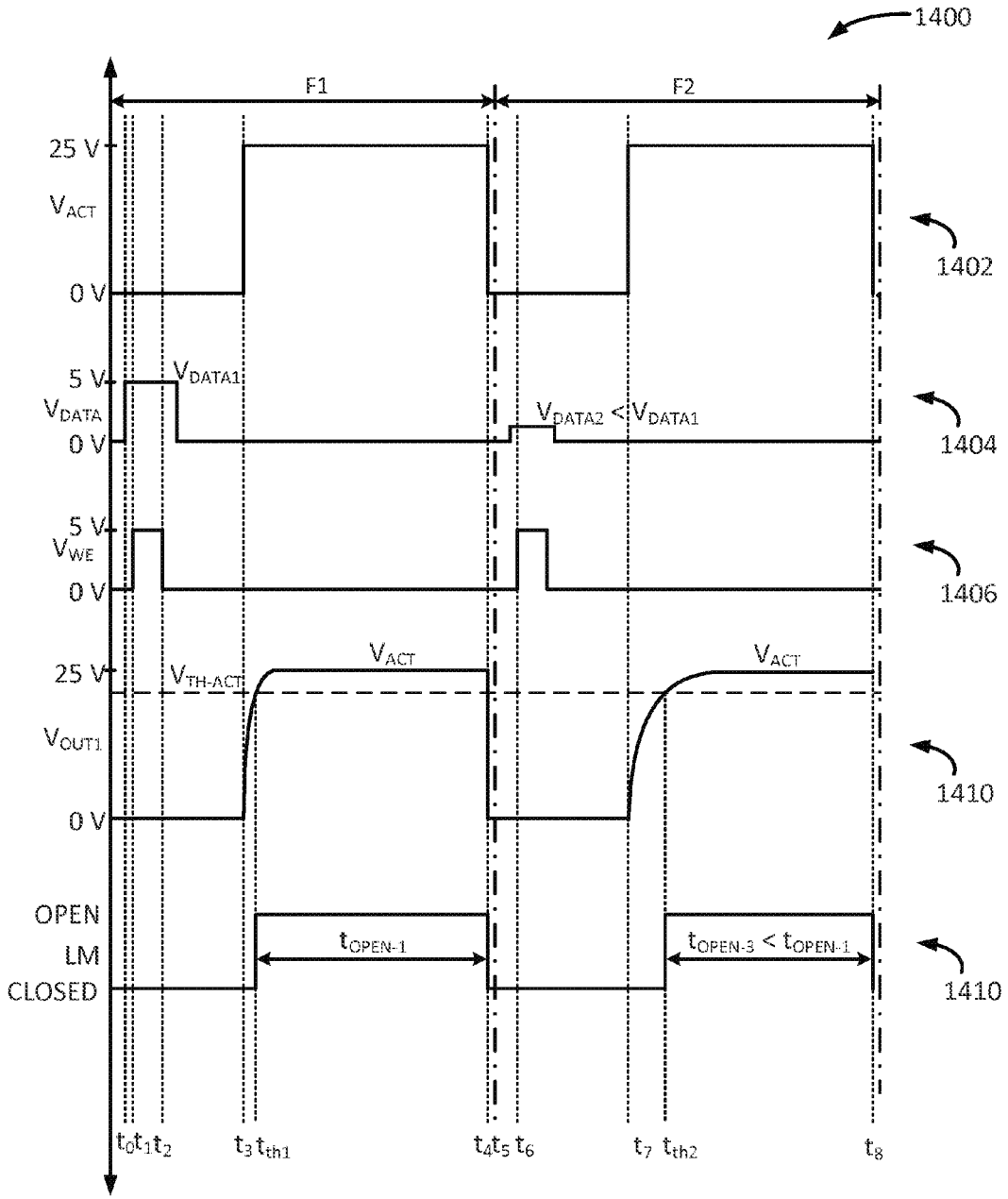
FIG. 14 shows another example timing diagram for the pixel circuit shown in FIG. 9.

FIG. 14 shows another example timing diagram 1400 for the pixel circuit 900 shown in FIG. 9. In particular, the timing diagram 1400 shows voltage levels at various nodes of the pixel circuit 900 while the pixel circuit 900 is operating in an analog mode. $V_{ACT}$ 1402 represents the actuation voltage on the actuation voltage interconnect 314, $V_{DATA}$ 1404 represents the data voltage at the data interconnect 310, $V_{WE}$ 1406 represents the write enable voltage on the write enable interconnect 312, $V_{OUT1}$ 1408 represents the output voltage at the first output node 326, and LM 1412 represents the state of the light modulator 302. The timing diagram 1400 shows the various voltage levels over two image frame periods F1 and F2.

The first image frame period F1 begins with a data loading period. The actuation voltage $V_{ACT}$ 1402, the data voltage $V_{DATA}$ 1404, and the write enable voltage $V_{WE}$ 1406 are maintained at a low voltage that is, for example, substantially equal to 0 V or the ground voltage. Thus, the voltage $V_{OUT1}$ 1410 at the first output node 326 is pulled low. This means that the shutter 334 is maintained at a low voltage of about 0 V. Assuming that the first actuator interconnect 904 and the second actuator interconnect 906 are maintained at about 25 V and 0 V, respectively, the shutter 334 would be pulled towards the first actuator 330. It is assumed that when the shutter 334 is pulled to the first actuator 330, the light modulator 302 is in a CLOSED state, while when the shutter 334 is pulled to the second actuator 332, the light modulator is in an OPEN state. Thus, as shown in FIG. 14, during the data loading period, the state 1410 of the light modulator 302 is CLOSED.

Also during the data loading period, at time $t_0$, the data interconnect 310 is loaded with the data voltage $V_{DATA1}$. Subsequently, at time $t_1$, the write enabling voltage $V_{WE}$ 1406 is increased to a high voltage such that both the data loading transistor 318 and the discharge transistor 324 are switched ON. As a result, the data voltage $V_{DATA1}$ is loaded onto the data storing capacitor 320. After the data voltage has been loaded onto the data storing capacitor 320, the write enable voltage $V_{WE}$ 1406 is brought low such that both the data loading transistor 318 and the discharge transistor 324 are switched OFF.

At time $t_3$, the data loading period ends and the actuation period begins. At this time, the actuation voltage $V_{ACT}$ 1402 on the actuation voltage interconnect 314 is increased to about 25 V. As discussed above in relation to FIG. 3, the increase in the actuation voltage $V_{ACT}$ 1402 to about 25 V also causes the voltage at the first output node 326 to increase to about 25 V. This increase in the voltage at the first output node 326 is a result of the combination of the switching ON of the actuation transistor 322 and the positive voltage feedback provided by the voltage feedback circuit 308. The rate at which the voltage at the first output node 326 increases to the actuation voltage, however, is a function of the data voltage $V_{DATA}$ stored in the data storing capacitor 320. Specifically, the rate at which the voltage at the first output node 326 reaches the actuation voltage increases with the increase in the data voltage $V_{DATA}$ stored in the data storing capacitor.

As shown in FIG. 14, as the voltage $V_{OUT1}$ 1410 at the first output node 326 increases, the voltage applied to the shutter 334 also increases. This means that the shutter 334 would be pulled by the second actuator 332, which is maintained at about 0 V. However, for the shutter 334 to be pulled towards the second actuator 332, the voltage on the shutter 334 would have to be equal to or greater than a threshold actuation voltage $V_{TH\text{-}ACT}$. The threshold actuation voltage $V_{TH\text{-}ACT}$ is a voltage which when achieved by the shutter 334 causes the electrostatic forces between the shutter 334 and the second actuator 332 to overcome the electrostatic forces that pull the shutter 334 to the first actuator 330. In some implementations, the threshold actuation voltage $V_{TH\text{-}ACT}$ can be a voltage at which the voltage difference between the shutter 334 and the first actuator 330 reduces below a maintenance voltage and the voltage difference between the shutter 334 and the second actuator 332 increases over an actuation voltage. As shown in FIG. 14, the voltage $V_{OUT1}$ at the first output node 326 reaches the threshold actuation voltage $V_{TH\text{-}ACT}$ at time $t_{th1}$. At this time, the shutter 334 is pulled towards the second actuator 332 causing the light modulator 302 to change its state from CLOSED to OPEN.

The light modulator 302 remains in the OPEN state for the remaining actuation period until time $t_4$. Specifically, the light modulator 302 remains in the OPEN state for period $t_{OPEN\text{-}1}$. After this period, the voltage $V_{OUT1}$ 1410 at the first output node 326 is pulled to about 0 V. This can cause the state 1410 of the light modulator 302 to switch back to the CLOSED state.

During the data loading period of the image frame period F2 starting at time $t_5$, a data voltage $V_{DATA2}$ is loaded into the data storing capacitor 320 at time $t_6$. The data voltage $V_{DATA2}$ is less than the data voltage $V_{DATA1}$ loaded during the image frame period F1. For example, $V_{DATA2}$ may be equal to about 1.5 V.

At time $t_7$, the actuation period of the image frame period F2 begins. As discussed above, at the beginning of the actuation period the actuation voltage $V_{ACT}$ 1402 increases to about 25 V. As the voltage across the actuation transistor 322 is greater than the threshold voltage of the actuation transistor 322, the actuation transistor 322 switches ON. This causes the voltage $V_{OUT1}$ at the first output node 326 to increase.

As discussed above, the rate at which the voltage $V_{OUT1}$ increases is a function of the data voltage stored in the data storing capacitor 320. The data voltage $V_{DATA2}$ stored in the data storage capacitor 320 during image frame period F2 is less than the data voltage $V_{DATA1}$ stored during the first image frame period F1. Therefore, the rate of increase of the voltage $V_{OUT1}$ 1410 corresponding to the data voltage $V_{DATA2}$ would be less than its rate of increase corresponding to the data voltage $V_{DATA1}$. As a result, in image frame period F2, it takes relatively longer for the voltage $V_{OUT1}$ 1410 to reach the actuation threshold voltage $V_{TH\text{-}ACT}$. For example, as shown in FIG. 14, the voltage $V_{OUT1}$ 1410 reaches the actuation threshold voltage $V_{TH\text{-}ACT}$ at time $t_{th2}$ (such that $|t_7-t_{th2}|>|t_3-t_{th1}|$). At this time, the shutter 334 is pulled towards the second actuator 332, and the light modulator 302 switches its state from the CLOSED state to the OPEN state.

The relatively slower rate of increase of the voltage at the shutter 334 results in a relatively shorter period for which the light modulator 302 can remain in the OPEN state. For example, for the image frame period F2, the light modulator 302 remains in the OPEN state for period $t_{OPEN\text{-}2}$, which is relatively shorter than the period $t_{OPEN\text{-}1}$ corresponding to image frame period F1. Assuming that the light-source is switched ON during the entire actuation period, the total intensity of light transmitted during an image frame period depends upon the time for which the light modulator 302 can remain in the OPEN state during the actuation period. As the time for which the light modulator 302 remains in the OPEN state can be controlled by selecting the appropriate data voltage $V_{DATA}$ 1404, the total intensity of light transmitted by a pixel during an image frame period can be controlled by storing the appropriate value of the data voltage $V_{DATA}$ into the data storage capacitor.

In some implementations, the analog operation of the pixel circuit 900 can be utilized to implement analog gray scale techniques in displaying images on a display. Using analog gray scale techniques can mitigate image artifacts such as flicker, dynamic false contouring (DFC), and color break-up (CBU) that can adversely affect the use of digital gray scale techniques in displaying images.

Figure 15:
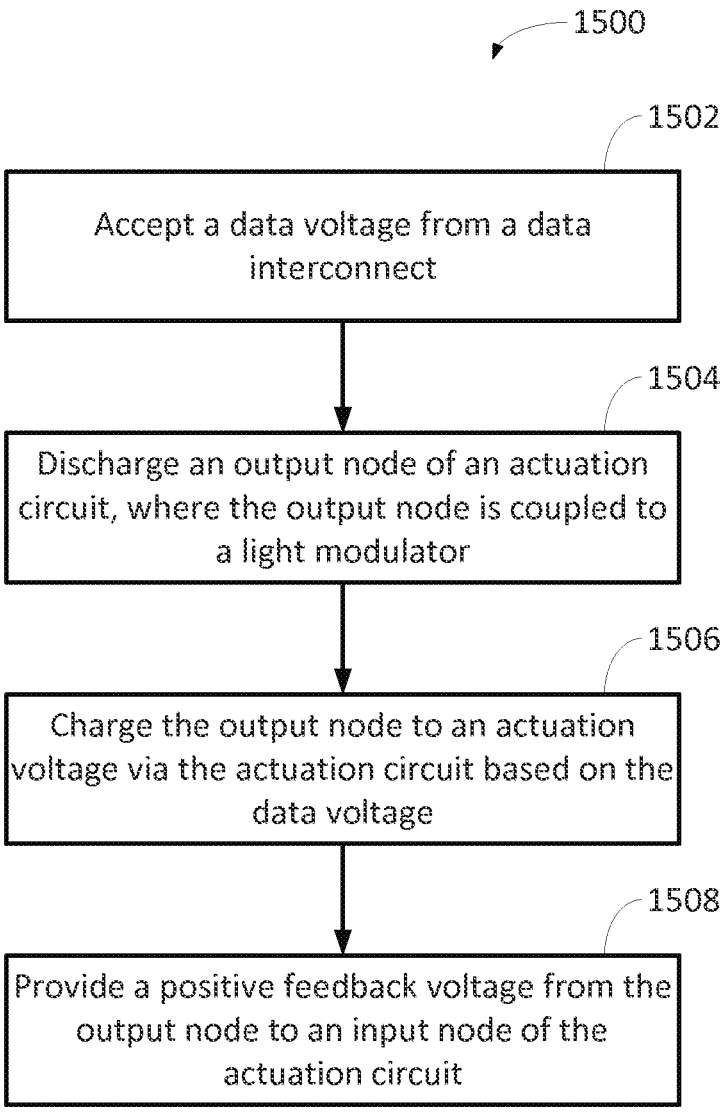
FIG. 15 shows a flow diagram of an example process for operating a light modulator using a pixel circuit.

FIG. 15 shows a flow diagram of an example process 1500 for operating a light modulator using a pixel circuit. In particular, the process 1500 includes accepting a data voltage from a data interconnect (stage 1502), discharging an output node of an actuation circuit, where the output node is coupled to a light modulator (stage 1504), charging the output node to an actuation voltage via the actuation circuit based on the data voltage (stage 1506), and providing a positive feedback voltage from the output node to the input node of the actuation circuit (stage 1508).

The process 1500 includes accepting a data voltage from a data interconnect (stage 1502). One example of this process stage has been discussed above in relation to FIG. 3. Specifically, FIG. 3 shows a data loading circuit 304 that is configured to load a data voltage appearing on the data interconnect 310. The data loading circuit 304 includes a data loading transistor 318, the ON or OFF state of which is controlled by the voltage on the write enable interconnect 312. When the voltage on the write enable interconnect 312 goes high, the data loading transistor 318 switches ON, causing the data voltage appearing on the data interconnect 310 to be stored on the data storing capacitor 320.

The process 1500 also includes discharging an output node of an actuation circuit, where the output node is coupled to a light modulator (stage 1504). One example of this process stage has been discussed above in relation to FIG. 3. For example, the pixel circuit 300 includes a discharge transistor 324 that is configured to discharge the first output node 326 of the actuation circuit 306. When the voltage on the write enable interconnect 312 goes high, the discharge transistor 324 switches ON, causing the voltage at the first output node 326 to be discharged to about 0 V.

The process 1500 also includes charging t/he output node to an actuation voltage via the actuation circuit based on the data voltage (stage 1506). One example of this process stage has been discussed above in relation to FIG. 3. Specifically, FIG. 3 shows an actuation transistor 322 configured to charge the first output node 326 to the actuation voltage supplied by the actuation voltage interconnect 314. If the data voltage stored on the data storing capacitor 320 is greater than the threshold voltage of the actuation transistor 322, the actuation transistor switches ON, causing the first output node 326 to be charged to the actuation voltage.

The process 1500 also includes providing a positive feedback voltage from the output node to the input node of the actuation circuit (stage 1508). One example of this process stage has been discussed above in relation to FIG. 3. Specifically, the pixel circuit 300 includes a voltage feedback circuit 308 that is configured to provide a positive feedback voltage at the input node of the actuation transistor 322. For example, as the voltage on the first output node 326 rises, a combination of the feedback transistor 329 and the floating data storing capacitor 320 provide a positive feedback voltage at the input node 328 of the actuation circuit 306.

Figure 16A:
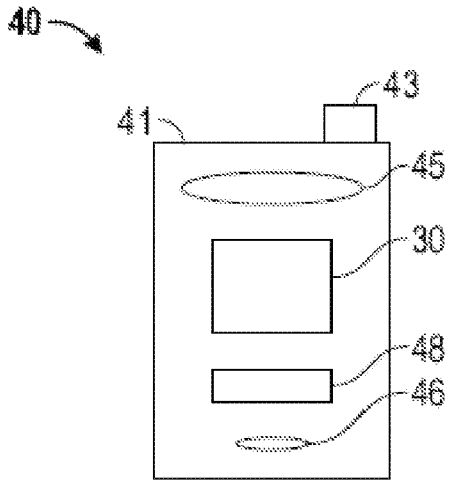
FIGS. 16A and 16B show system block diagrams of an example display device that includes a plurality of display elements.
Figure 16B:
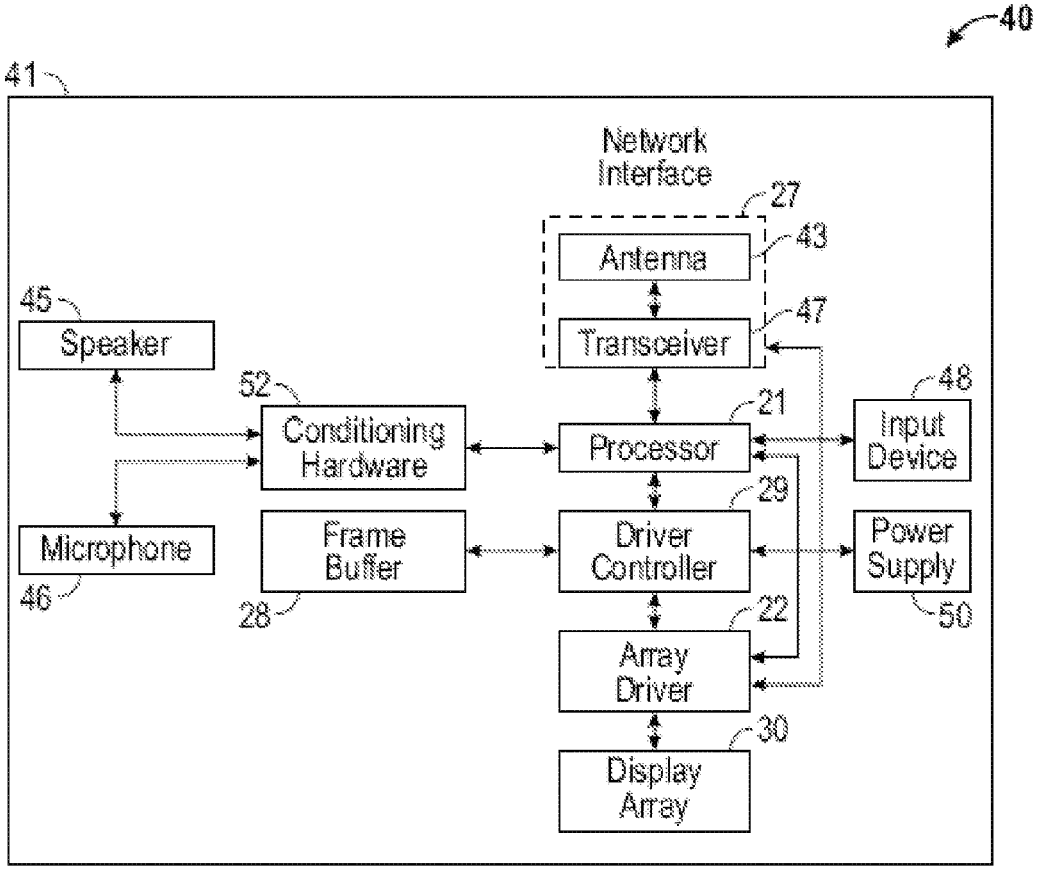

FIGS. 16A and 16B show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be capable of including a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 16B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 16A, can be capable of functioning as a memory device and be capable of communicating with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to any of the IEEE 16.11 standards, or any of the IEEE 802.11 standards. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1×EV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G, or further implementations thereof, technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29 is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40. Additionally, in some implementations, voice commands can be used for controlling display parameters and settings.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus, comprising:

a data loading circuit capable of accepting a data voltage;

a light modulator capable of selectively allowing passage of light;

an actuation circuit having an input node and an output node, the input node coupled to the data loading circuit and the output node coupled to the light modulator, capable of providing an actuation voltage to the light modulator based on the data voltage, and a positive feedback circuit, capable of providing a positive feedback voltage from the output node to the input node, including a switch that is capable of coupling the input node to an actuation voltage interconnect that provides the actuation voltage and which is controlled based on a voltage on the output node.

2. The apparatus of claim 1, wherein the positive feedback circuit includes a data storing capacitor coupled between the input node and the output node, and wherein the data storing capacitor is capable of storing the data voltage.

3. The apparatus of claim 2, wherein the data storing capacitor is a floating capacitor.

4. The apparatus of claim 1, wherein the switch is capable of providing an actuation voltage to the input node in response to the output node being charged to the actuation voltage via the actuation circuit.

5. The apparatus of claim 1, wherein the light modulator includes a shutter terminal, a first actuator terminal and a second actuator terminal, and wherein the output node is coupled to one of the first actuator terminal and the second actuator terminal.

6. The apparatus of claim 5, wherein a voltage at the shutter terminal is toggled such that a previous state of the light modulator is preserved when the output node is discharged by the actuation circuit.

7. The apparatus of claim 1, wherein the light modulator includes a shutter terminal, a first actuator terminal and a second actuator terminal, and wherein the output node is coupled to the shutter terminal.

8. The apparatus of claim 7, wherein the voltages at the first actuator terminal and the second actuator terminal are switched from being complementary to being non-complementary such that a previous state of the light modulator is preserved when the output node is discharged by the actuation circuit.

9. The apparatus of claim 1, wherein a period of a state of the light modulator is a function of the magnitude of the data voltage.

10. The display device of claim 9, wherein the display device uses analog grayscale technique for displaying an image.

11. The apparatus of claim 1, further comprising:

a display including:

the light modulator, the data loading circuit, the actuation circuit, and the positive feedback circuit, a processor that is capable of communicating with the display, the processor being capable of processing image data; and a memory device that is capable of communicating with the processor.

12. The apparatus of claim 11, the display further including:

a driver circuit capable of sending at least one signal to the display; and a controller capable of sending at least a portion of the image data to the driver circuit.

13. The apparatus of claim 11, further including:

an image source module capable of sending the image data to the processor, wherein the image source module includes at least one of a receiver, transceiver, and transmitter.

14. The apparatus of claim 11, the display further including:

an input device capable of receiving input data and to communicate the input data to the processor.

15. A method, comprising:

accepting a data voltage from a data interconnect;

discharging an output node of an actuation circuit, wherein the output node is coupled to a light modulator capable of switching between two discrete states;

charging the output node to an actuation voltage via the actuation circuit based on the data voltage; and providing a positive feedback voltage from the output node to an input node of the actuation circuit by controlling a switch, based on a voltage on the output node, to couple the input node to an actuation voltage interconnect that provides the actuation voltage.

16. The method of claim 15, wherein accepting the data voltage from a data interconnect includes storing the data voltage into a data storing capacitor.

17. The method of claim 15, wherein accepting the data voltage from the data interconnect includes accepting the data voltage from the data interconnect concurrently with discharging the output node of the actuation circuit.

18. The method of claim 15, wherein providing the positive feedback voltage from the output node to the input node of the actuation circuit includes charging the input node in response to a charging of the output node via the actuation circuit.

19. The method of claim 18, wherein charging the input node in response to a charging of the output node via the actuation circuit includes charging the input node via the switch.

20. The method of claim 18, wherein charging the input node in response to a charging of the output node via the actuation circuit includes charging the input node via the data storing capacitor to a voltage that is greater than the voltage at the output node by the magnitude of the data voltage.

21. The method of claim 15, further comprising providing a voltage at the output node to one of at least two actuators of the light modulator.

22. The method of claim 21, further comprising toggling a voltage at a shutter terminal of the light modulator during discharging the output node of the actuation circuit such that a previous state of the light modulator is preserved.

23. The method of claim 15, further comprising providing a voltage at the output node to a shutter terminal of the light modulator.

24. The method of claim 23, further comprising switching the voltages at a first actuator terminal and a second actuator terminal from being complementary to being non-complementary during discharging the output node.

25. The method of claim 15, wherein charging the output node to an actuation voltage via the actuation circuit based on the data voltage includes charging the output node at a rate that is a function of the magnitude of the data voltage.

26. The method of claim 25, further comprising displaying an image using analog grayscale technique.

27. An apparatus including a circuit for controlling a display element, comprising:

data acquiring means for accepting a data voltage from a data interconnect;

discharging means for discharging an output of an actuation circuit, the output node coupled to a light modulator;

charging means for charging the output node to an actuation voltage via the actuation circuit based on the data voltage; and feedback means providing a positive feedback voltage from the output node to an input node of the actuation circuit including a switch that is capable of coupling the input node to an actuation voltage interconnect that provides the actuation voltage and which is controlled based on a voltage on the output node.

28. The apparatus of claim 27, wherein the data acquiring means are capable of storing the data voltage on a data storing capacitor.

29. The apparatus of claim 27, wherein the feedback means are capable of charging the input node in response to a charging of the output node via the charging means.

30. The apparatus of claim 27, wherein the feedback means includes a floating data storing capacitor coupled between the input node and the output node, the floating data storing capacitor capable of storing the data voltage.

* * * * *